US008463154B2

(12) United States Patent
Akizuki et al.

(10) Patent No.: US 8,463,154 B2
(45) Date of Patent: Jun. 11, 2013

(54) IMAGE FORMING APPARATUS

(75) Inventors: Tomoo Akizuki, Suntou-gun (JP); Keisuke Ishizumi, Mishima (JP); Seiji Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 321 days.

(21) Appl. No.: 13/011,080

(22) Filed: Jan. 21, 2011

(65) Prior Publication Data

US 2011/0188881 A1 Aug. 4, 2011

(30) Foreign Application Priority Data

Jan. 29, 2010 (JP) ..... 2010-019801

(51) Int. Cl.
*G03G 21/00* (2006.01)

(52) U.S. Cl.
USPC ..... 399/99; 399/302; 399/354

(58) Field of Classification Search
USPC ..... 399/99, 101, 302, 354, 357
See application file for complete search history.

(56) References Cited

U.S. PATENT DOCUMENTS

| | | | | |
|---|---|---|---|---|
| 5,732,310 | A | 3/1998 | Hiroshima et al. | |
| 6,856,777 | B2 | 2/2005 | Enomoto et al. | |
| 7,190,919 | B2 * | 3/2007 | Kitagawa | 399/101 |
| 7,215,920 | B2 * | 5/2007 | Shida | 399/354 |

FOREIGN PATENT DOCUMENTS

| | | | |
|---|---|---|---|
| JP | 3267507 | B2 | 3/2002 |
| JP | 2003-255723 | A | 9/2003 |
| JP | 2009-63681 | A | 3/2009 |

* cited by examiner

*Primary Examiner* — Hoang Ngo
(74) *Attorney, Agent, or Firm* — Fitzpatrick, Cella, Harper & Scinto

(57) ABSTRACT

The image forming apparatus is capable of collecting discharged toner satisfactorily even when a power source for discharging toner from a voltage application member to a moving member and a power source for collecting the discharged toner from the moving member onto an image bearing member are provided in common.

6 Claims, 14 Drawing Sheets

IMAGE FORMING APPARATUS

BACKGROUND OF THE INVENTION

1. Field of the Invention

The present invention relates to an image forming apparatus using an electrophotographic system, such as a laser printer, a copier, and a facsimile.

2. Description of the Related Art

Conventionally, as an image forming apparatus of an electrophotographic system, there is an image forming apparatus of an intermediate transfer system that primarily transfers a toner image, which is formed on an electrophotographic photosensitive member (photosensitive member) as an image bearing member, onto an intermediate transfer member, and then, secondarily transfers the toner image onto a recording material. Further, as the image forming apparatus of the intermediate transfer system, for example, a tandem-type (or in-line type) image forming apparatus is known, which primarily transfers toner images of a plurality of colors respectively formed on a plurality of photosensitive members onto an intermediate transfer member so that the toner images are superimposed successively, and then, secondarily transfers the toner images onto a recording material at a time. In the image forming apparatus of the intermediate transfer system, toner (residual toner) remains on the intermediate transfer member after the secondary transfer step. Therefore, the image forming apparatus of the intermediate transfer system is provided with an intermediate transfer member cleaning device for removing and collecting the residual toner.

Japanese Patent No. 3267507 discloses an intermediate transfer member cleaning device that allows residual toner to be charged oppositely to a normal charge polarity of toner, and then, transfers the residual toner from an intermediate transfer member onto a photosensitive member in a primary transfer part of an image forming part immediately. Then, the intermediate transfer member cleaning device allows the residual toner to be collected by a cleaning device of a photosensitive member. According to this method, a waste toner container for collecting toner dedicated for an intermediate transfer member can be eliminated. Further, the intermediate transfer member can be cleaned simultaneously with the primary transfer. Further, according to this method, there is an advantage in that a dedicated toner containing mechanism for collecting the residual toner is not required. In the case of adopting the method of collecting residual toner transferred from the intermediate transfer member onto the photosensitive member as described above, the intermediate transfer member cleaning device including a toner charging roller as a toner charging member that charges residual toner is provided. The residual toner adhering to the toner charging roller during an image formation operation is discharged (that is, transferred) onto the intermediate transfer member at a predetermined timing during an operation after the image formation operation. As a specific method of discharging the residual toner from the toner charging roller, a method of repeating application of a negative voltage and application of a positive voltage with respect to the toner charging roller alternately, with a time period of a substantially one round of the toner charging roller being a half period may be conceived.

By the way, in order to reduce a size and cost of an image forming apparatus, it is effective to share a high-voltage power supply circuit used in the image forming apparatus.

However, when the high-voltage power supply circuit is shared, there is such a risk that toner may not be collected exactly from an intermediate transfer member in some cases.

For example, when a power source for discharging toner from a toner charging roller onto an intermediate transfer member and a power source for collecting toner, which is discharged onto the intermediate transfer member, in a photosensitive member are provided in common, the following problem arises. That is, an application timing of a voltage for discharging toner is not matched with an application timing of a voltage for collecting toner which has been discharged (discharged toner), and the discharged toner cannot be collected in the primary transfer part to remain on the intermediate transfer member.

SUMMARY OF THE INVENTION

An object of the present invention is to provide an image forming apparatus capable of collecting discharged toner satisfactorily even when a power source for discharging toner from a voltage application member onto a moving member and a power source for collecting the discharged toner from the moving member onto an image bearing member are provided in common.

Another object of the present invention is to provide an image forming apparatus An image forming apparatus comprising an image bearing member that bears a toner image an intermediate transfer member which is rotatable, a primary transfer member that transfers the toner image from the image bearing member onto the intermediate transfer member in a primary transfer part, a secondary transfer member that transfers the toner image from the intermediate transfer member onto a transfer material in a secondary transfer part, a toner charging member that is provided downstream of the secondary transfer part and upstream of the primary transfer part in a moving direction of the intermediate transfer member, and charges residual toner remaining on the intermediate transfer member, and a common power source that applies a voltage to the primary transfer member and/or the toner charging member, wherein the image forming apparatus is capable of performing a belt cleaning mode in which the residual toner is charged in an opposite polarity opposite to a normal polarity of toner by the toner charging member, and then the charged residual toner is transferred from the intermediate transfer member to the image bearing member by the primary transfer member, and a toner charging member cleaning mode in which the residual toner adhering to the toner charging member is transferred from the toner charging member to the intermediate transfer member, and after then residual toner transferred from the toner charging member to the intermediate transfer member is transferred from the intermediate transfer member to the image bearing member by the primary transfer member, wherein the common power source applies one of voltages of a first polarity and a second polarity opposite to the first polarity, into the primary transfer member and the toner charging member simultaneously, and wherein in a case of performing the toner charging member cleaning mode, the common power source applies the voltage of the first polarity to the primary transfer member and the toner charging member at a timing at which the residual toner, which is transferred from the toner charging member to the intermediate transfer member when the voltage of the first polarity is applied to the toner charging member, reaches the primary transfer part.

Further features of the present invention will become apparent from the following description of exemplary embodiments with reference to the attached drawings.

DESCRIPTION OF THE EMBODIMENTS

Embodiments of the present invention will be described in detail by way of embodiment with reference to the drawings. The sizes, materials, forms, and relative configuration of components described in the following embodiments may be changed as appropriate depending on the configuration and conditions of an apparatus that incorporates the present invention.

First Embodiment

Figure 1:
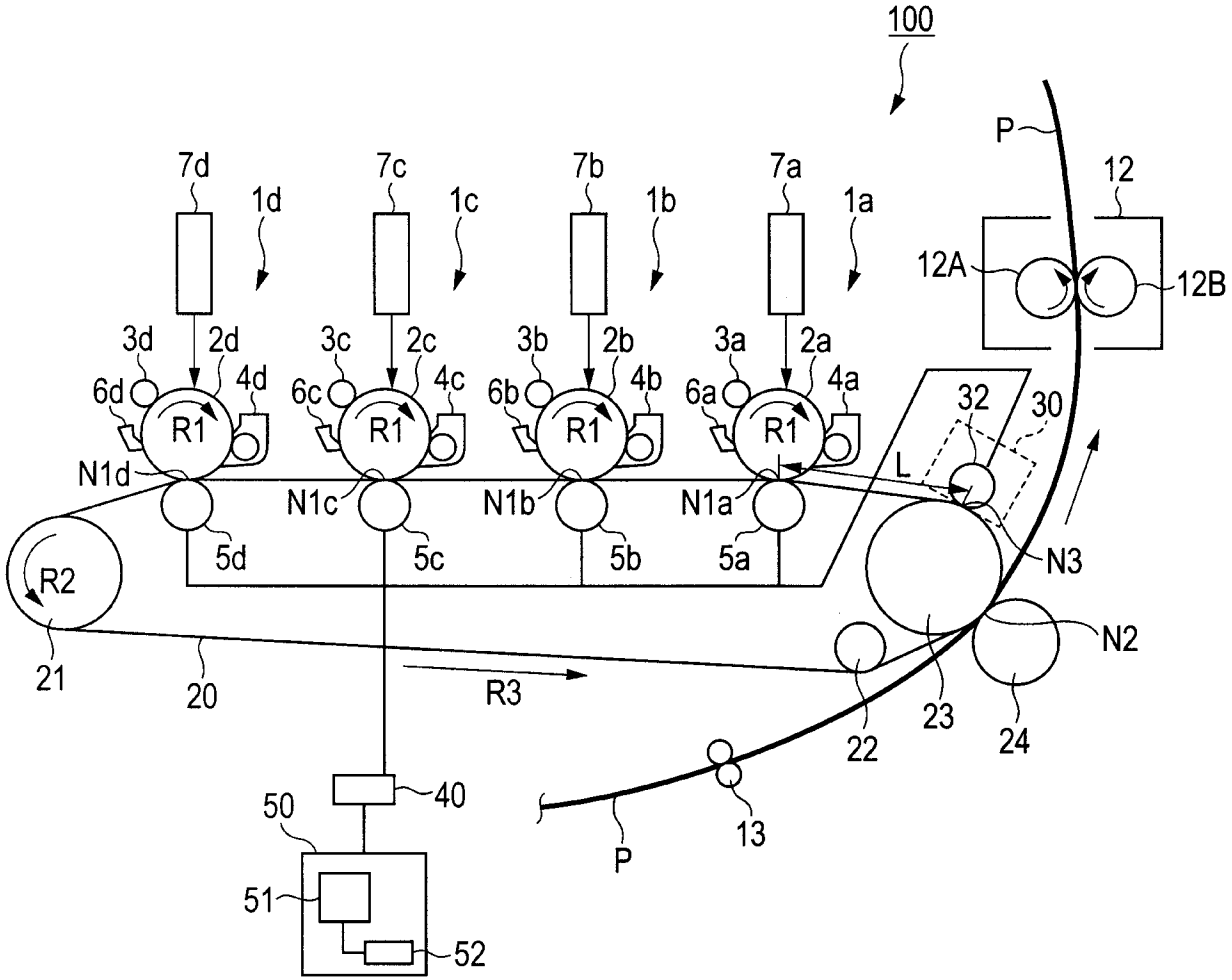
FIG. 1 is a schematic cross-sectional view of an image forming apparatus according to an embodiment of the present invention.

FIG. 1 illustrates a schematic cross-section of an image forming apparatus according to an embodiment of the present invention. In this embodiment, an image forming apparatus 100 is a tandem-type full-color printer adopting an intermediate transfer system capable of forming a full-color image using an electrophotographic system.

The image forming apparatus 100 includes four image forming parts: first, second, third, and fourth image forming parts 1*a*, 1*b*, 1*c*, and 1*d* as a plurality of image forming parts. The first, second, third, and fourth image forming parts 1*a*, 1*b*, 1*c*, and 1*d* form images of the respective colors of yellow (Y), magenta (M), cyan (C), and black (K). Further, the first, second, third, and fourth image forming parts 1*a*, 1*b*, 1*c*, and 1*d* are placed in a line at a predetermined interval.

In this embodiment, the first, second, third, and fourth image forming parts 1*a*, 1*b*, 1*c*, and 1*d* have configurations and operations mostly in common. Thus, hereinafter, unless otherwise required, those elements are described collectively, omitting letters a, b, c, and d given to reference symbols in the drawings so as to express that the elements are provided for any of the image forming parts.

In the image forming part 1, a cylindrical photosensitive member as an image bearing member, i.e., a photosensitive drum 2 is placed. On the periphery of the photosensitive drum 2, a charge roller 3 as charge means and a developing device 4 as developing means are placed. Further, a primary transfer roller 5 as a primary transfer member and a drum cleaning device 6 as photosensitive member cleaning means are placed. In an upper portion in the figure between the charge roller 3 and the developing device 4, an exposure device 7 as exposure means is placed. The respective developing devices 4*a*, 4*b*, 4*c*, and 4*d* contain toner of the respective colors of yellow, magenta, cyan, and black as developer.

An endless belt as an intermediate transfer member, i.e., an intermediate transfer belt 20 is placed so as to be opposed to the respective photosensitive drums 2*a* to 2*d* of the first to fourth image forming parts 1*a* to 1*d*. The intermediate transfer belt 20 is a moving member. The intermediate transfer belt 20 is wound around a drive roller 21, a tension roller 22, and a secondary transfer counter roller 23 as support members. The intermediate transfer belt 20 is rotated (moves around) in a direction (counterclockwise direction) indicated by an arrow R3 of the figure when the drive roller 21 is rotatably driven in a direction (counterclockwise direction) indicated by an arrow R2 of the figure. The respective primary transfer rollers 5*a* to 5*d* that are primary transfer members are placed on an inner circumferential surface side of the intermediate transfer belt 20 and abut on the respective photosensitive drums 2*a* to 2*d* via the intermediate transfer belt 20 to form primary transfer parts N1*a* to N1*d* where the intermediate transfer belt 20 and the respective photosensitive drums 2*a* to 2*d* are brought into contact with each other. On an outer circumferential surface side of the intermediate transfer belt 20, a secondary transfer roller 24 as a secondary transfer member is placed so as to be opposed to the secondary transfer counter roller 23. The secondary transfer roller 24 abuts on the secondary transfer counter roller 23 via the intermediate transfer belt 20, and forms a secondary transfer part N2 where the intermediate transfer belt 20 and the secondary transfer roller 24 are brought into contact with each other.

In this embodiment, the photosensitive drum 2 is a negatively chargeable organic photosensitive drum, and has a photosensitive layer on a drum base made of aluminum. The photosensitive drum 2 is rotatably driven at a predetermined circumferential velocity (100 mm/second in this embodiment) in a direction (clockwise direction) indicated by an arrow R1 of the figure by a drive device (not shown). In this embodiment, the circumferential velocity of the photosensitive drum 2 corresponds to a process speed of the image forming apparatus 100.

The charge roller 3 is in contact with the photosensitive drum 2 under a predetermined pressure force. The charge roller 3 is supplied with a predetermined charge voltage by a charge voltage power source (not shown) as charge voltage application means and charges the surface of the photosensitive drum 2 to a predetermined potential uniformly. In this embodiment, the photosensitive drum 2 is charged negatively by the charge roller 3.

The exposure device 7 is a laser scanner device in this embodiment. In the exposure device 7, laser light modulated in accordance with a time-series electric digital image signal of image information input from a host computer (not shown) is output from a laser output part, and the laser light is guided to the surface of the photosensitive drum 2 via a reflective mirror to expose the photosensitive drum 2 to light. Thus, an electrostatic latent image (electrostatic image) in accordance with image information is formed on the surface of the photosensitive drum 2 charged by the charge roller 3.

The developing device 4 adopts a contact developing system. Further, in this embodiment, the normal charge polarity of the toner which the developing device 4 uses for developing the electrostatic image is negative. The developing device 4 has a developing roller as a developer bearing member. The toner borne in a thin layer shape on the developing roller is transported to a counterpart (developing part) with respect to the photosensitive drum 2 when the developing roller is rotatably driven by a drive device (not shown). The electrostatic image formed on the photosensitive drum 2 is developed as a toner image with toner in the developing part. At this time, the developing roller is supplied with a predetermined developing voltage by a developing voltage power source (not shown) as a developing voltage application device. Note that, according to this embodiment, in a full-color image forming mode (mode for forming an image using all the first to fourth image forming parts), the developing roller of the developing device 4 and the photosensitive drum 2 abut on each other in all the first to fourth image forming parts 1*a* to 1*d*. On the other hand, in a monochromic image forming mode (mode for forming an image with one of the first to fourth image forming parts), the developing roller of the developing device 4 and the photosensitive drum 2 are separated from each other in an image forming part other than the image forming part for forming the image. The purpose of this is to suppress the deterioration and consumption of the developing roller and toner.

The drum cleaning device 6 includes a cleaning blade that is a plate-shaped member formed of an elastic material as a cleaning member that abuts on the photosensitive drum 2, and a toner container. The drum cleaning device 6 scrapes off and removes the toner adhering to the surface of the photosensitive drum 2 from the surface of the photosensitive drum 2 with the cleaning blade and collects the toner in the toner container.

As the intermediate transfer belt 20, an endless belt formed of a resin such as poly(vinylidene fluoride) (PVDF), thermoplastic fluorine resin, polyimide, polyethylene terephtharate (PET), and polycarbonate can be used. Alternatively, as the intermediate transfer belt 20, an endless belt can be used, in which a rubber base layer such as EPDM is covered with urethane rubber containing a fluorine resin such as PTFE dispersed therein.

The primary transfer roller 5 is formed of an elastic member such as sponge rubber, and rotates following the intermediate transfer belt 20. A power source 40 that is a common power source is connected to the respective primary transfer rollers 5*a* to 5*d*. The respective primary transfer rollers 5*a* to 5*d* are supplied with a primary transfer voltage from the single power source 40.

A secondary transfer voltage power source (not shown) as secondary transfer voltage application means is connected to the secondary transfer roller 24. The secondary transfer roller 24 is supplied with a secondary transfer voltage from the secondary transfer voltage power source.

A belt cleaning device 30 as an intermediate transfer member cleaning device is placed in the vicinity of the secondary transfer counter roller 23 on the outer circumferential surface side of the intermediate transfer belt 20. The configuration and operation of the belt cleaning device 30 are described in detail later.

Further, on a downstream side in the transportation direction of a recording material P from the secondary transfer part N2, a fixing device 12 including a fixing roller 12A and a pressure roller 12B is placed as fixing unit. Further, on an upstream side in the transportation direction of the recording material P from the secondary transfer part N2, resist rollers 13 for sending the recording material P to the secondary transfer part N2 at a predetermined timing is placed.

When an image formation operation start signal is generated, toner images are formed by the respective charge rollers 3*a* to 3*d*, the respective exposure devices 7*a* to 7*d*, and the respective developing devices 4*a* to 4*d* on the respective photosensitive drums 2*a* to 2*d* to be rotatably driven at a predetermined process speed.

The toner images formed on the respective photosensitive drums 2*a* to 2*d* are primarily transferred onto the rotating intermediate transfer belt 20 due to the function of the respective primary transfer rollers 5*a* to 5*d* in the respective primary transfer parts N1*a* to N1*d*. At this time, the respective primary transfer rollers 5*a* to 5*d* are supplied with a primary transfer voltage charged oppositely to the normal charge polarity of the toner by the power source 40.

The toner images primarily transferred onto the intermediate transfer belt 20 move while being held on the intermediate transfer belt 20. The intermediate transfer belt 20 is rotatably driven at a predetermined circumferential velocity (100 mm/second in this embodiment) in the direction indicated by the arrow R3 of the figure. That is, in this embodiment, the intermediate transfer belt 20 is rotatably driven so that a moving speed S of the surface thereof becomes equal to the circumferential velocity of the photosensitive drum 2 corresponding to the process speed of the image forming apparatus 100.

Further, the recording material P is transported to the secondary transfer part N2 by the resist rollers 13 in synchronization with a timing at which the leading end of the toner images on the intermediate transfer belt 20 moves to the secondary transfer part N2. Then, in the secondary transfer part N2, the toner images on the intermediate transfer belt 20 are secondarily transferred at a time onto the recording material P due to the function of the secondary transfer roller 24. At this time, the secondary transfer roller 24 is supplied with a secondary transfer voltage charged oppositely to the normal charge polarity of the toner by the secondary transfer voltage power source.

After that, the recording material P with the toner image transferred on the surface thereof is transported to the fixing device 12. Then, the recording material P is heated and pressed in a fixing portion between the fixing roller 12A and the pressure roller 12B placed in the fixing device 12, and the toner image is heat (fuse) fixed on the surface of the recording material P. After that, the recording material P is discharged out of the image forming apparatus 100. Thus, a full-color image is formed on the recording material P.

The toner remaining on the photosensitive drum 2 after the primary transfer step is removed and collected by the drum cleaning device 6. Further, the toner (residual toner) remaining on the intermediate transfer belt 20 after the secondary transfer step is removed and collected using the belt cleaning device 30, as described later in detail.

The belt cleaning device 30 includes a toner charging roller 32 as a toner charging member for charging residual toner. The toner charging roller 32 is placed so as to be brought into contact with the intermediate transfer belt 20 in a voltage application part N3 on a downstream side of the secondary transfer part N2 and on an upstream side of the primary transfer part N1*a* of the first image forming part 1*a* in the moving direction of the intermediate transfer belt 20. Further, the toner charging roller 32 plays a role of charging the residual toner oppositely to the normal charge polarity of the toner.

As the toner charging roller 32, there is used a nickel-plated steel bar having an outer diameter of 6 mm covered with a solid elastic body having a thickness of 4 mm and containing carbon dispersed in EPDM rubber. That is, in this embodiment, a radius R of the toner charging roller 32 is 7 mm. Further, in this embodiment, an electric resistance of the toner charging roller 32 is $5.0\times10^{7}\Omega$ under the application of a voltage of 500 V.

The power source 40 that is a common power source is connected to the toner charging roller 32. The power source 40 is common to that for applying a primary transfer voltage to the respective primary transfer rollers 5*a* to 5*d*. The primary transfer rollers 5*a* to 5*d* and the toner charging member 32 to be supplied with a voltage are supplied with voltages having the same polarity at the same time by the power source 40. The voltage to be applied to the toner charging roller 32 varies depending upon a material for the toner charging roller 32 and the environment (temperature, humidity) in which the image forming apparatus 100 is used. For example, under the NN environment at a temperature of 23° C. and a humidity of 50%, a voltage of +800 V is applied to the toner charging roller 32 during the image formation operation. The power source 40 that is a common power source applies one of a voltage having the first polarity and a voltage having the second polarity, which is opposite to the first polarity, to the primary transfer member and the toner charging member simultaneously. Here, description is made with the voltage of the first polarity being a positive voltage and the voltage of the second polarity being a negative voltage.

The residual toner on the intermediate transfer belt 20 can be charged positively by applying a positive voltage to the toner charging roller 32. The residual toner charged positively on the intermediate transfer belt 20 moves to the primary transfer part N1*a* of the first image forming part 1*a* and is transferred from the intermediate transfer belt 20 to the photosensitive drum 2*a* of the first image forming part 1*a* due to the function of the voltage applied to the primary transfer roller 5*a* of the first image forming part 1*a*. At this time, a positive primary transfer voltage is applied to the primary transfer roller 5*a* of the first image forming part 1*a*. After that, the toner transferred onto the photosensitive drum 2*a* is collected by the drum cleaning device 6*a* in the first image forming part 1*a*. Generally, the transfer of the residual toner from the intermediate transfer belt 20 onto the photosensitive drum 2*a* is performed simultaneously with the primary transfer of the toner image from the photosensitive drum 2*a* onto the intermediate transfer belt 20. Thus, in order to remove the residual toner from the intermediate transfer belt 20, the image forming apparatus charges the residual toner oppositely to the normal charge polarity of the toner by the toner charging member, and then, a belt cleaning mode can be executed in which the charged residual toner is transferred from the intermediate transfer member to the image bearing member by the primary transfer member.

Toner adheres to the surface of the toner charging roller 32 little by little by continuing the image formation. As a result, the charging treatment of the residual toner by the toner charging roller 32 cannot be stably performed any more, and the cleaning performance of the residual toner is degraded. Then, the toner charging member cleaning mode can be performed at a predetermined timing, in which the toner adhering to the toner charging roller 32 is discharged (i.e., transferred) to the intermediate transfer belt 20 and the toner adhering to the toner charging roller 32 is cleaned. This suppresses the degradation in cleaning performance of the residual toner using the toner charging roller 32.

In the toner charging member cleaning mode, the power source 40 alternately applies, to the toner charging roller 32, a negative DC voltage Vn1 that has a polarity which is the same as the normal charge polarity of the toner and a positive DC voltage Vp1 that has a polarity that is opposite to the normal charge polarity of the toner. When the negative DC voltage Vn1 is applied to the toner charging roller 32, the negatively charged toner adhering to the toner charging roller 32 is discharged. On the other hand, when the positive DC voltage Vp1 is applied to the toner charging roller 32, the positively charged toner adhering to the toner charging roller 32 is discharged. In this embodiment, the voltage Vn1 is −800 V and the voltage Vp1 is +800 V.

The toner discharged from the toner charging roller 32 onto the intermediate transfer belt 20 is transferred from the intermediate transfer belt 20 onto the photosensitive drum 2 in the primary transfer part N1, and collected by the drum cleaning device 6, as described later in detail. This is performed at a timing (during no image formation) at which an image to be transferred onto the recording material P for output is not formed during the toner charging member cleaning mode. Further, in this embodiment, during the discharge step, the discharged toner is collected in the toner container of the drum cleaning device 6*a* of the first image forming part 1*a*.

Next, a relationship between switch timing of a polarity of a voltage (hereinafter, also referred to as "discharge voltage") applied to the toner charging roller 32 during the toner charging member cleaning mode and the position of discharged toner on the intermediate transfer belt 20 is described. In the following, the timing at which the toner charging member cleaning mode is performed is defined as a discharge step.

Figure 2:
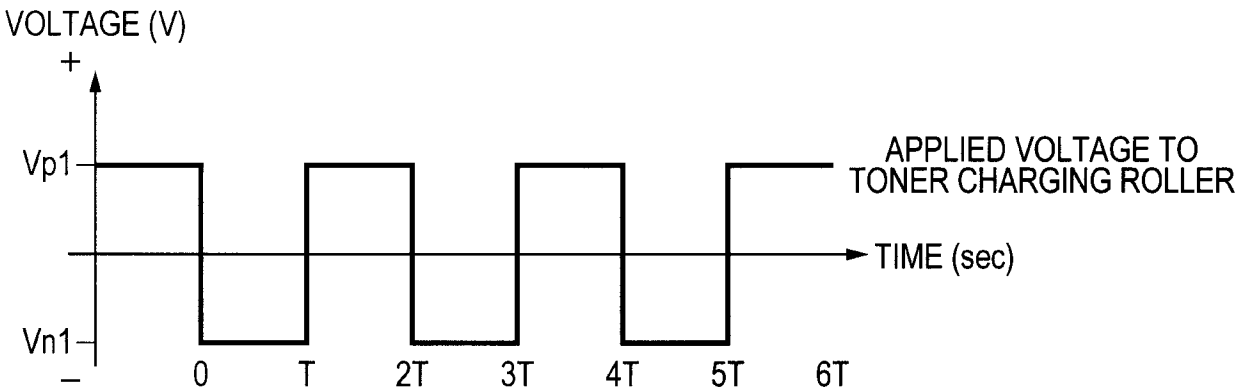
FIG. 2 is a graphic diagram illustrating a variation with the elapsed time of a voltage applied to a toner charging roller during a discharge step.

FIG. 2 illustrates a variation with the elapsed time of a discharge voltage in the discharge step. A positive voltage is applied to the toner charging roller 32 during normal image formation, and hence the timing at which the polarity of the voltage to be applied to the toner charging roller 32 for the first time after the toner discharge step is started is switched to a negative voltage is set as a reference point of time 0 second. In this embodiment, at timings of time 0 second, 2T seconds, and 4T seconds, the discharge voltage is switched from the positive voltage Vp1 to the negative voltage Vn1. Further, at timings of time T seconds, 3T seconds, and 5T seconds, a discharge voltage is switched from the negative voltage Vn1 to the positive voltage Vp1. That is, the voltage applied to the toner charging roller 32 during the discharge step is switched alternately between the voltage Vn1 and the voltage Vp1 every T seconds.

In this embodiment, the single power source 40 is used in common, and hence, in the discharge step, the positive voltage and the negative voltage are alternately switched to be applied to the primary transfer rollers 5*a* to 5*d* at the same timing as that of the discharge voltage.

Figure 3:
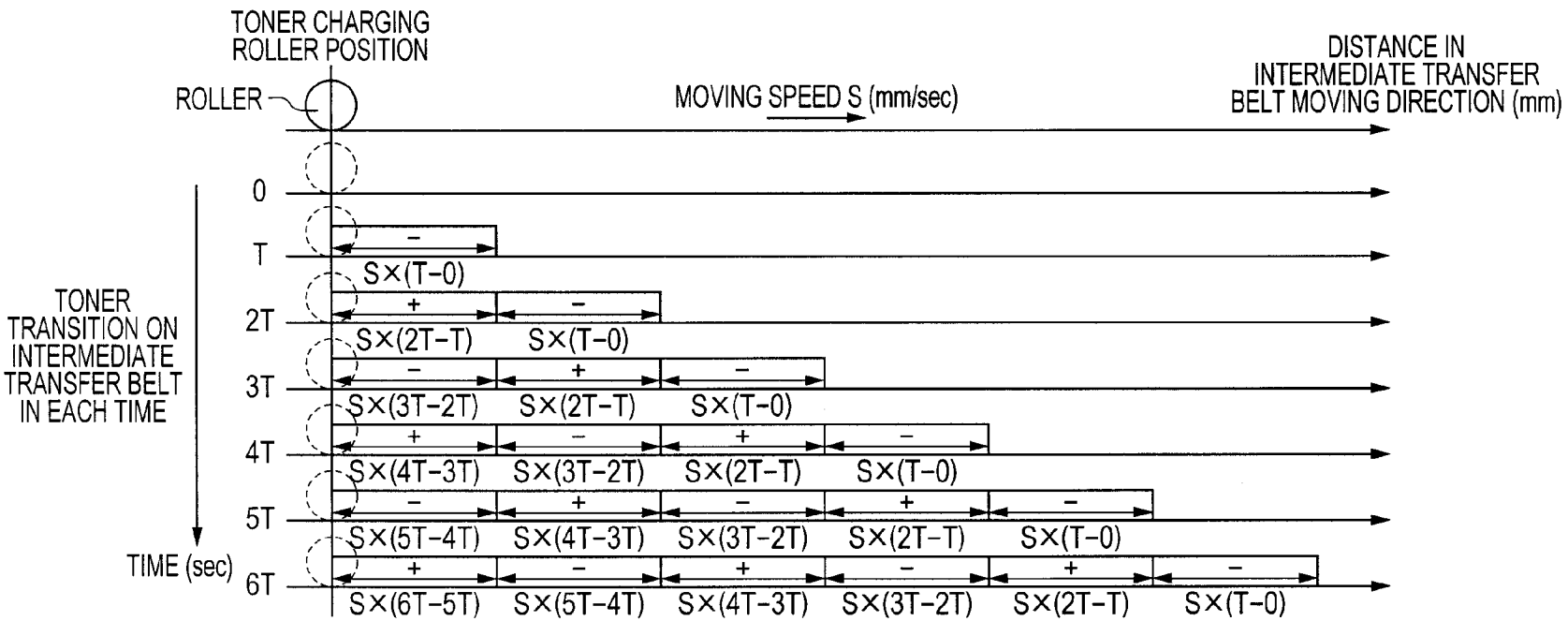
FIG. 3 is an explanatory view illustrating an example of the transfer of a position of discharged toner on an intermediate transfer belt in each time during the discharge step.

FIG. 3 illustrates a variation with the elapsed time of a position of discharged toner on the intermediate transfer belt 20 in each time during the discharge step. At the timing of time 0 second, negative toner is in a state of just moving from the toner charging roller 32 onto the intermediate transfer belt 20 at the position of the toner charging roller 32. During a period between the time 0 second and the time T seconds, the negative discharged toner is transferred from the toner charging roller 32 onto the intermediate transfer belt 20 with a length of S [mm/second]×(1-0) [second] (=S×T [mm]). Then, at the timing of the time T seconds, the positive discharged toner on the toner charging roller 32 is in a state of just moving from the toner charging roller 32 to the intermediate transfer belt 20. During a period between the time T seconds and the time 2T seconds, the positive discharged toner is transferred from the toner charging roller 32 onto the intermediate transfer belt 20 with a length of S [mm/second]×(2T−T) [second] (=S×T [mm]).

Note that, the positive voltage is applied to the toner charging roller 32 during normal image formation, and hence the negative toner mainly adheres to the surface of the toner charging roller 32. The positive toner discharged from the toner charging roller 32 during the period between the time T seconds and the time 2T seconds is mainly obtained when the charge polarity of the negative toner is inverted to be positive due to the generation of a discharge current while the positive voltage is applied to the toner charging roller 32. Thus, the amount of positively charged discharged toner described above is smaller than the amount of negatively charged discharged toner.

Subsequently, even during periods between the time 2T seconds and the time 3T seconds, between the time 3T seconds and the time 4T seconds, between the time 4T seconds and the time 5T seconds, and between the time 5T seconds and the time 6T seconds, the movement of the discharged toner and the transfer of the discharged toner from the toner charging roller 32 to the intermediate transfer belt 20 are performed due to repetition of the similar operation.

Next, the positional relationship of the primary transfer part in which the discharged toner can be collected satisfactorily is described. Note that, in this embodiment, the position of the voltage application part N3 is represented by the position at the center in the moving direction of the intermediate transfer belt 20 in a region where the toner charging roller 32 and the intermediate transfer belt 20 are in contact. Further, in this embodiment, the position of the primary transfer part N1 is described with the position at the center in the moving direction of the intermediate transfer belt 20 in a region where the photosensitive drum 2 and the intermediate transfer belt 20 are in contact in the primary transfer part N1.

Figure 4:
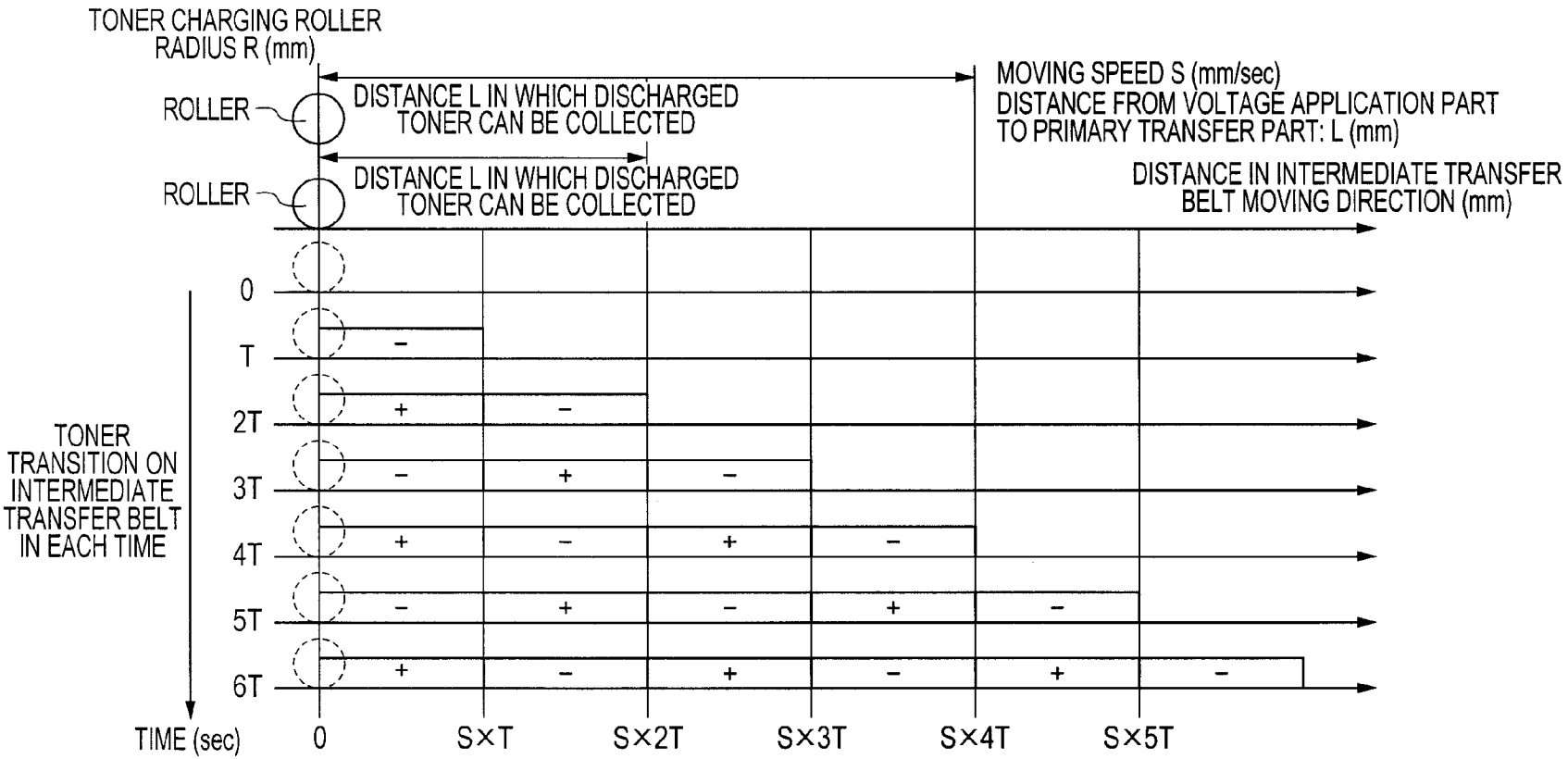
FIG. 4 is an explanatory view illustrating an example of a positional relationship of a primary transfer part.

FIG. 4 illustrates a positional relationship of the primary transfer part N1*a* in which discharged toner can be collected onto the photosensitive drum 2*a* of the first image forming part 1*a*, in a diagram similar to FIG. 3. In FIG. 4, the case where the primary transfer part N1*a* of the first image forming part 1*a* is present at the leading end position of the negative discharged toner on the intermediate transfer belt 20 at the timing of the time 2T seconds is considered. That is, the case where the primary transfer part N1*a* of the first image forming part 1*a* is present at the position of S×2T [mm] in the moving direction of the intermediate transfer belt 20, with the position of the voltage application part N3 being a reference position (0 mm), is considered.

During the period between the time 2T seconds and the time 3T seconds, the negative voltage is applied to the primary transfer roller 5*a* of the primary transfer part N1*a* by the power source 40 common to that of the toner charging roller 32. Further, the length of the negative discharged toner (discharged during the period between the time 0 second and the time T seconds) on the intermediate transfer belt 20 is S×T [mm]. Thus, during the application time period of the negative voltage to the primary transfer roller 5*a* just between the time 2T seconds and the time 3T seconds, the negative discharged toner can be collected onto the photosensitive drum 2*a* of the first image forming part 1*a*. During the period between the time 3T seconds and the time 4T seconds, the positive voltage is applied to the primary transfer roller 5*a* of the primary transfer part N1*a* by the power source 40 common to that of the toner charging roller 32. Further, the length of the positive discharged toner (discharged during the period between the time T seconds and the time 2T seconds) on the intermediate transfer belt 20 is S×T [mm]. Thus, during the application time period of the positive voltage to the primary transfer roller 5*a* just between the time 3T seconds and the time 4T seconds, the positive discharged toner can be collected onto the photosensitive drum 2*a* of the first image forming part 1*a*. After that, the negative discharged toner whose leading end has reached the primary transfer part N1*a* at timings of the time 4T seconds and the time 6T seconds and the positive discharged toner whose leading end has reached the primary transfer part N1*a* at a timing of the time 5T seconds can be collected onto the photosensitive drum 2*a* similarly.

Next, in FIG. 4, the case where the primary transfer part N1*a* of the first image forming part 1*a* is present at the leading end position of the negative discharged toner on the intermediate transfer belt 20 at a timing of the time 4T seconds is considered. That is, the case where the primary transfer part N1*a* of the first image forming part 1*a* is present at a position of S×4T [mm] in the moving direction of the intermediate transfer belt 20, with the position of the toner charging roller 32 being a reference position (0 mm), is considered. As is understood from FIG. 4, even in this case, the discharged toner can be collected onto the photosensitive drum 2*a* of the first image forming part 1*a* in the same way as in the case where the primary transfer part N1*a* is present at the position of S×2T [mm].

It is understood from the above that, in order to collect the discharged toner onto the photosensitive drum 2*a* of the first image forming part 1*a*, the position of the primary transfer part N1*a* of the first image forming part 1*a* preferably satisfies the following relationships.

(1) The negative voltage is applied to the primary transfer roller 5*a* when the leading end of the negative discharged toner reaches the primary transfer part N1*a*, and, on the contrary the positive voltage is applied to the primary transfer roller 5*a* when the leading end of the positive discharged toner reaches the primary transfer part N1*a*.

(2) A trailing end of the negative discharged toner has passed completely through the primary transfer part N1*a* before the negative voltage applied to the primary transfer roller 5*a* starts being switched to the positive voltage. On the contrary, the trailing end of the positive discharged toner has passed completely through the primary transfer part N1*a* before the positive voltage applied to the primary transfer roller 5*a* starts being switched to the negative voltage.

That is, the following is understood. The moving distance of the intermediate transfer belt 20 from the voltage application part N3 to the primary transfer part N1*a* of the first image forming part 1*a* is set as L [mm]. Further, a half-period for switching of the polarity of the discharge voltage during the discharge step, i.e., the length of a time band (hereinafter, also referred to as "unit discharge time period") in which the positive or negative discharge voltage is applied is set as T [second]. Further, the moving speed of the intermediate transfer belt 20 is set as S [mm/second]. At this time, in order to enable the satisfactory collection of the discharged toner onto the photosensitive drum 2*a* in the primary transfer part N1*a* of the first image forming part 1*a*, the following relationship:

$$L \approx S \times (2 \times n \times T) \text{(where n is a natural number)} \quad (1)$$

is preferably satisfied. That is, the following relationship:

$$T \approx L/(S \times 2 \times n) \text{(where n is a natural number)} \quad (2)$$

is preferably satisfied.

In this case, after (almost simultaneously) the region of the intermediate transfer belt 20 having passed through the voltage application part N3 when a negative discharge voltage is applied to the toner charging member 32 passes completely through the primary transfer part N1*a* of the first image forming part 1*a*, the polarity of a discharge voltage is switched to be positive. Similarly, after (almost simultaneously) the region of the intermediate transfer belt 20 having passed through the voltage application part N3 when a positive discharge voltage is applied to the toner charging member 32 passes through the primary transfer part N1*a* of the fist image forming part 1*a*, the polarity of a discharge voltage is switched to be negative.

Here, a switch period 2T [second] (twice the unit discharge time period T [second]) of the polarity of a discharge voltage is obtained by dividing the moving distance L [mm] of the intermediate transfer belt 20 from the voltage application part N3 to the primary transfer part N1*a* by the moving speed S [mm/second] of the intermediate transfer belt 20. Then, one region of the negative discharged toner on the intermediate transfer belt 20 and one region of the positive discharged toner thereon are considered as one set (one period of switch of the polarity of the discharge voltage) of discharged toner in the discharge operation. In this case, the natural number n means that n set(s) of discharged toner is (are) discharged in the moving distance L [mm] of the intermediate transfer belt 20 from the voltage application part N3 to the primary transfer part N1*a*.

Note that, in order to satisfactorily collect both the negative and positive discharged toners, which are discharged onto the intermediate transfer belt 20 in the voltage application part N3, onto the photosensitive drum 2*a* in the primary transfer part N1*a* of the first image forming part 1*a*, it is necessary that the relationship of $2T<L/S$ is satisfied.

In this embodiment, the discharged toner from the toner charging roller 32 is collected in the drum cleaning device 6*a* of the first image forming part 1*a*, and the moving distance L of the intermediate transfer belt 20 from the voltage application part N3 to the primary transfer part N1*a* is 100 mm. As described above, the moving speed S of the intermediate transfer belt 20 is 100 mm/second. Therefore, in order to enable the collection of the discharged toner onto the photosensitive drum 2*a* in the primary transfer part N1*a* of the first image forming part 1*a*, it is preferred that the unit discharge time period T [second] be substantially equal to 0.5/n [second]. In this embodiment, T is set to 0.5 seconds.

In this embodiment, the length of discharged toner on the intermediate transfer belt 20 discharged during the unit discharge time period T of 0.5 seconds is $S\times T=50$ mm. On the other hand, the radius R of the toner charging roller 32 is 7 mm, and the length of one circumference thereof ($2\times\pi\times R$) is about 44 mm. Thus, in this embodiment, the relationship of $S\times T>2\times\pi\times R$ (that is, $T>2\pi R/S$) is satisfied. Therefore, in the length of discharged toner of 50 mm on the intermediate transfer belt 20 discharged during the unit discharge time period T, the amount of discharged toner is large in about 44 mm corresponding to the length of one circumference of the toner charging roller 32 and the amount of discharged toner is small in the remaining 6 mm.

Figure 5:
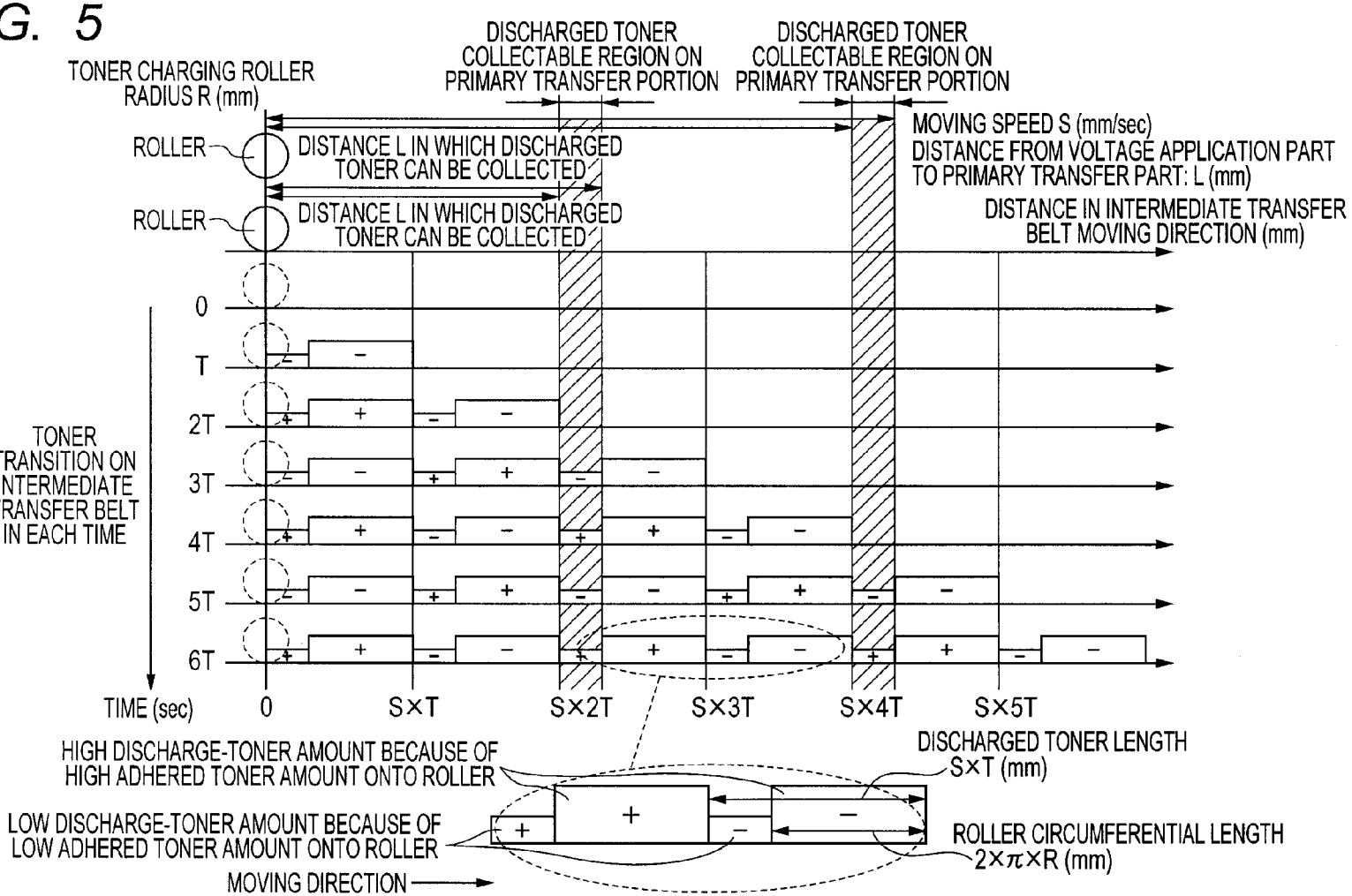
FIG. 5 is a more detailed explanatory view illustrating the example of the positional relationship of the primary transfer part.

FIG. 5 illustrates a diagram similar to FIG. 4, which describes more detail of the case where the length of discharged toner on the intermediate transfer belt 20 discharged during the unit discharge time period T is larger than the length of one circumference of the toner charging roller 32. As described above, the amount of discharged toner decreases as the number of rotations increases, that is, toward the second and third rotations, after a discharge voltage starts being applied in the discharge step. Therefore, after the polarity of a discharge voltage is switched as desired, no collection of the discharged toner can be permitted from the second rotation of the toner charging roller 32. This can further enlarge the range of the position of the primary transfer part N1*a* where the discharged toner can be collected to the photosensitive drum 2*a* of the first image forming part 1*a*. As is understood from FIG. 5, in this case, the following relationship is required to be satisfied.

$$S\times 2\times n\times T\leqq L\leqq S\times(2n+1)\times T-2\pi R \quad (3)$$

(where n is a natural number)

That is, under a certain distance L [mm], in the case where the unit discharge time period T [second] satisfies the following relationship:

$$L/(S\times 2\times n)\geqq T\geqq(L+2\pi R)/(S\times(2n+1)) \quad (4)$$

(where n is a natural number), the discharged toner can be collected onto the photosensitive drum 2*a* in the primary transfer part N1*a* of the first image forming part 1*a* sufficiently to an acceptable degree.

In this embodiment, an output of the power source 40 applying a voltage to the toner charging roller 32 and the primary transfer rollers 5*a* to 5*d* is controlled by a CPU 51 as control means of a control part 50 for controlling the operation of the image forming apparatus 100 collectively. The CPU 51 controls a voltage output value of the power source 40 and the switch of the polarity of an output voltage according to the program and data stored in a memory 52 as storage means of the control part 50.

Hereinabove, in this embodiment, the image forming apparatus 100 has at least the primary transfer roller 5*a* of the image forming part 1*a* collecting the discharged toner and the common power source 40 for applying a voltage to the toner charging roller 32. Further, the image forming apparatus 100 performs a discharge step of discharging toner from the toner charging roller 32. In the discharge step, toner is transferred from the toner charging roller 32 to the intermediate transfer belt 20 in a contact portion (voltage application part) N3 between the toner charging roller 32 and the intermediate transfer belt 20, and the toner is transferred from the intermediate transfer belt 20 to the photosensitive drum 2*a* in the primary transfer part N1*a*. During the discharge step, a positive or negative voltage of a first polarity is applied to the toner charging roller 32 and the primary transfer roller 5*a* by the power source 40 over a first time band. Further, during the discharge step, a voltage of a second polarity that is opposite to the first polarity is applied to the toner charging roller 32 and the primary transfer roller 5*a* by the power source 40 over a second time band. During the discharge step, those operations are repeated alternately while moving the intermediate transfer belt 20. Then, during the discharge step, the power source 40 switches the polarity of the voltage to be applied from the second polarity to the first polarity before the region of the intermediate transfer belt 20 that is in contact with the toner charging roller 32 reaches the primary transfer part N1*a* in the first time band. Further, during the discharge step, the power source 40 switches the polarity of the voltage to be applied from the first polarity to the second polarity before the region of the intermediate transfer belt 20 that is in contact with the toner charging roller 32 reaches the primary transfer part N1*a* in the second time band.

Preferably, during the discharge step, the power source 40 continues to apply a voltage of the first polarity to both the rollers 32, 5*a* until the region of the intermediate transfer belt 20 that is in contact with the toner charging roller 32 passes through the primary transfer part N1*a* in the first time band. Further, preferably, during the discharge step, the power source 40 continues to apply a voltage of the second polarity to both the rollers 32, 5*a* until the region of the intermediate transfer belt 20 that is in contact with the toner charging roller 32 passes through the primary transfer part N1*a* in the second time band. Thus, the discharged toner from the toner charging roller 32 can be collected satisfactorily onto the photosensitive drum 2*a* in the primary transfer part N1*a* of the predetermined image forming part 1*a*, and the poor picture which occurred by defective cleaning and the contamination of a back side of the recording material P caused by discharged toner can be suppressed.

Second Embodiment

Figure 6:
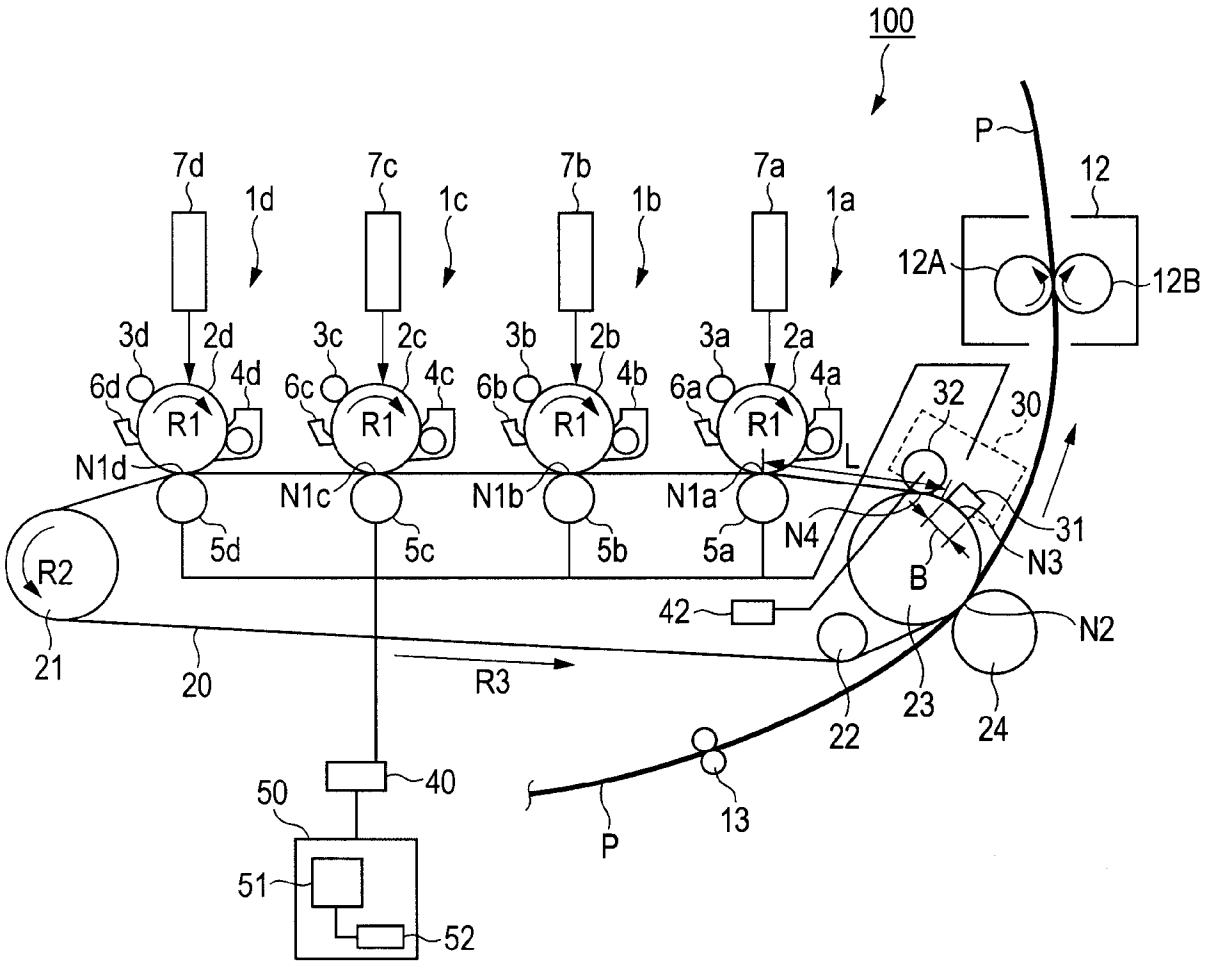
FIG. 6 is a schematic cross-sectional view of an image forming apparatus according to another embodiment of the present invention.

Next, another embodiment of the present invention is described. FIG. 6 illustrates a schematic cross-section of the image forming apparatus 100 of this embodiment. The basic configuration and operation of the image forming apparatus of this embodiment are the same as those of the first embodiment, but are different from the first embodiment in the configuration and operation of the belt cleaning device 30. Thus, the elements having functions and configurations that are the same as or correspond to those of the first embodiment are denoted with the same reference symbols as those therein, and the detailed description thereof is omitted.

In this embodiment, the belt cleaning device 30 as intermediate transfer member cleaning means includes a conductive brush (first toner charging member) 31 and a toner charging roller (second toner charging member) 32 as toner charging members that are voltage application members. During the discharge step, toner is discharged from the conductive brush 31 onto the intermediate transfer belt 20. Further, the conductive brush 31 and the primary transfer roller 5*a* of the first image forming part 1*a* collecting discharged toner have the power source 40 in common. Hereinafter, more detailed description is made.

The belt cleaning device 30 includes the conductive brush 31 as the first toner charging member that collects and holds a part of residual toner, and the toner charging roller 32 as the second toner charging member that charges the residual toner.

The conductive brush 31 is placed so as to be brought into contact with the intermediate transfer belt 20 in the first voltage application part N3 on the downstream side of the secondary transfer part N2 and on the upstream side of the primary transfer part N1*a* of the first image forming part 1*a* in the moving direction of the intermediate transfer belt 20. The conductive brush 31 has its position fixed in the moving direction of the intermediate transfer belt 20, and is brought into contact with the intermediate transfer belt 20 to rub against the intermediate transfer belt 20.

In this embodiment, the conductive brush 31 is made of nylon and is set to have a fineness of 7 deci Tex, a pile length of 5 mm, and an electric resistance of $1.0\times10^{6}\Omega$. Further, in this embodiment, a width B (width of a contact portion (first voltage application part N3) between the conductive brush 31 and the intermediate transfer belt 20) of the conductive brush 31 in the moving direction of the intermediate transfer belt 20 is set to 5 mm.

The power source 40 that is a power source part common to the power source part that applies a primary transfer voltage to each of the primary transfer rollers 5*a* to 5*d* is connected to the conductive brush 31, and a predetermined DC voltage is applied to the conductive brush 31 from the power source 40. A voltage to be applied to the conductive brush 31 varies depending upon the material for the conductive brush 31, the environment in which the image forming apparatus 100 is used (temperature, humidity), etc. For example, in an NN environment at a temperature of 23° C. and a humidity of 50%, a voltage of +800 V is applied to the conductive brush 31 during the image formation operation.

In general, negatively charged toner, toner that is hardly charged, and positively charged toner are mixed in the residual toner. When a positive voltage is applied to the conductive brush 31, mainly the negatively charged toner of the residual toner with mixed charge polarities is collected by the conductive brush 31. The conductive brush 31 also physically collects the positively charged toner although it is in a small amount. Toner having passed through the conductive brush 31 without being collected by the conductive brush 31 hardly includes negatively charged toner.

The toner charging roller 32 is placed so as to be brought into contact with the intermediate transfer belt 20 in a second voltage application part N4 on the downstream side of the conductive brush 31 and on the upstream side of the primary transfer part N1*a* of the first image forming part 1*a* in the moving direction of the intermediate transfer belt 20. Further, the toner charging roller 32 plays a role of charging the residual toner which has not been collected by the conductive brush 31 to a desired positive charge amount with a polarity opposite to the normal charge polarity of the toner.

In this embodiment, a toner charge power source 42 as voltage application means is connected to the toner charging roller 32, and a predetermined DC voltage is applied from the toner charge power source 42 to the toner charging roller 32. A voltage to be applied to the toner charging roller 32 varies depending upon the material for the toner charging roller 32, the environment (temperature, humidity) in which the image forming apparatus 100 is used, etc. For example, in an NN environment at a temperature of 23° C. and a humidity of 50%, a voltage of +800 V is applied to the toner charging roller 32 during the image formation operation.

The toner on the intermediate transfer belt 20 can be charged uniformly and positively by applying a positive voltage to the toner charging roller 32. The toner charged positively on the intermediate transfer belt 20 moves to the primary transfer part N1*a* of the first image forming part 1*a* and is transferred from the intermediate transfer belt 20 onto the photosensitive drum 2*a* of the first image forming part 1*a* due to the function of the primary transfer roller 5*a* of the first image forming part 1*a*. At this time, a positive primary transfer voltage is applied to the primary transfer roller 5*a* of the first image forming part 1*a*. After that, the toner transferred onto the photosensitive drum 2*a* is collected by the drum cleaning device 6*a* in the first image forming part 1*a*.

The toner collected and held by the conductive brush 31 is accumulated as the number of images to be formed increases. Once the amount of the collected toner reaches a predetermined amount, toner cannot be collected or held any more, which degrades the cleaning performance of residual toner.

Then, the discharge step as a voltage application member cleaning step is performed, in which the toner held by the conductive brush 31 is discharged (that is, transferred) onto the intermediate transfer belt 20 at a predetermined timing so as to reduce the amount of toner accumulated in the conductive brush 31.

During the discharge step, a negative DC voltage Vn2 that has the same polarity as the normal charge polarity of the toner and a positive DC voltage Vp2 that has a polarity that is opposite to the normal charge polarity of the toner are applied alternately to the conductive brush 31. When the negative DC voltage Vn2 is applied to the conductive brush 31, the negatively charged toner held by the conductive brush 31 is discharged. When the positive DC voltage Vp2 is applied to the conductive brush 31, the positively charged toner held by the conductive brush 31 is discharged. By switching the polarity of the voltage to be applied to the conductive brush 31 repeatedly as described above, the toner accumulated in the conductive brush 31 is reduced, and thus, the conductive brush 31 can satisfactorily collect and hold toner again. In this embodiment, the voltage Vn2 is −800 V, and the voltage Vp2 is +800 V.

The discharged toner that has transferred from the conductive brush 31 onto the intermediate transfer belt during the discharge step moves together with the intermediate transfer belt 20 to reach the toner charging roller 32. At this time, the discharged toner from the conductive brush 31 adheres to the toner charging roller 32 to suppress the surface of the toner charging roller 32 from being contaminated, and hence, a voltage of the same polarity as that of the discharged toner is applied to the toner charging roller 32.

That is, during the discharge step, a negative DC voltage Vn3 and a positive DC voltage Vp3 are alternately applied to the toner charging roller 32 by the toner charge power source 42 in accordance with the arrival timing of the discharged toner from the conductive brush 31 to the toner charging roller 32. In this embodiment, the voltage Vn3 is −800 V, and the voltage Vp3 is +800 V. This causes the discharged toner from the conductive brush 31 to adhere to the toner charging roller 32, thereby being capable of suppressing the surface of the toner charging roller 32 from being contaminated.

Figure 7:
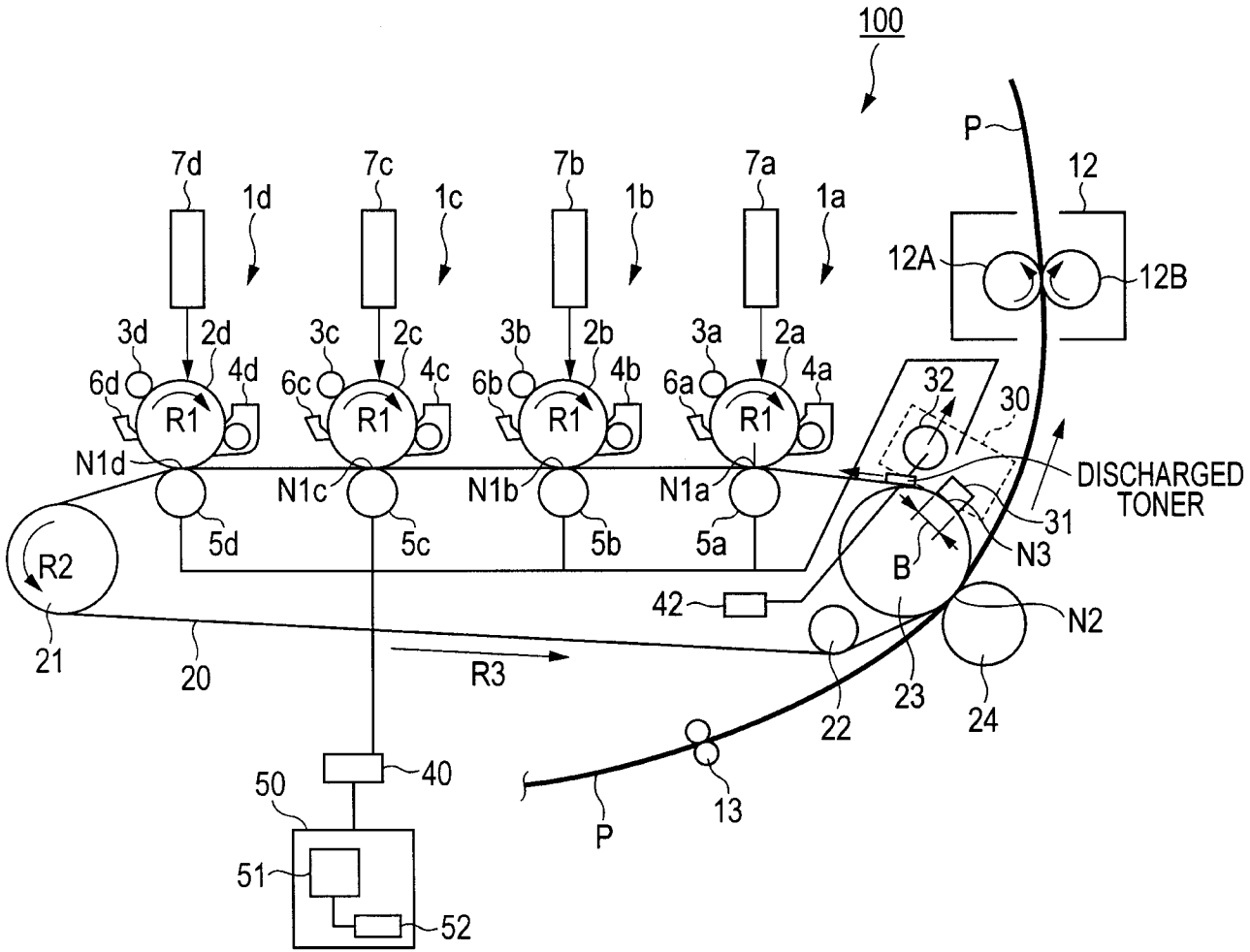
FIG. 7 is a schematic cross-sectional view of an image forming apparatus according to still another embodiment of the present invention.

Note that, in order to prevent the discharged toner from the conductive brush 31 from adhering to the toner charging roller 32 to contaminate the surface thereof, the toner charging roller 32 may be retracted physically by putting the toner charging roller 32 off the intermediate transfer belt 20. FIG. 7 illustrates a state in which the toner charging roller 32 is separated from the intermediate transfer belt 20.

In the same way as in the first embodiment, the discharge step is performed at a timing (during non-image formation) at which an image to be transferred to the recording material P for output is not formed, such as post-rotation operation that is a preparation or arrangement operation after the image formation. According to this embodiment, in the discharge step, the discharged toner is collected in the toner container of the drum cleaning device 6*a* of the first image forming part 1*a*.

Figure 8:
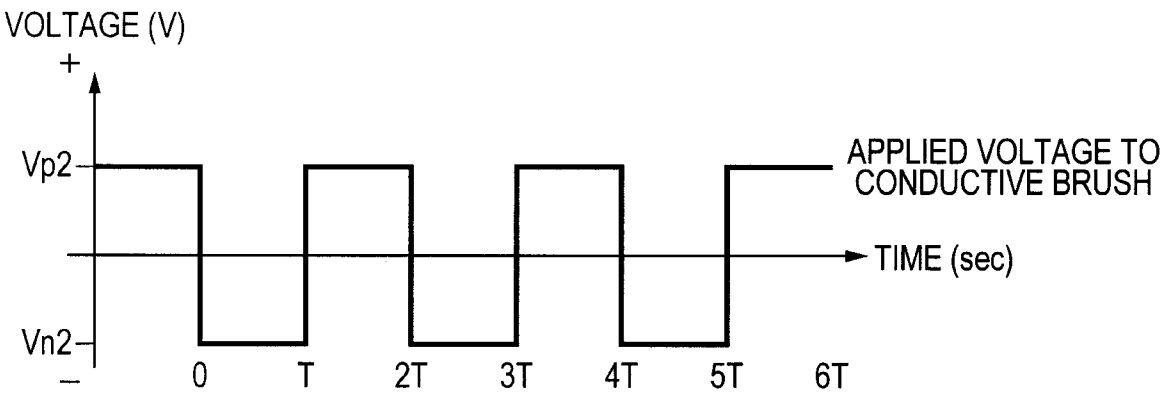
FIG. 8 is a graphic diagram illustrating a variation with the elapsed time of a voltage applied to a conductive brush during a discharge step.

Next, a relationship between the switch timing of the polarity of the voltage (discharge voltage) to be applied to the conductive brush 31 during the discharge step and the position of discharged toner on the intermediate transfer belt 20 is described. FIG. 8 illustrates a variation with the elapsed time of the discharge voltage during the discharge step. As described in FIG. 8, a variation with the elapsed time of the discharge voltage is the same as that in the first embodiment.

Figure 9:
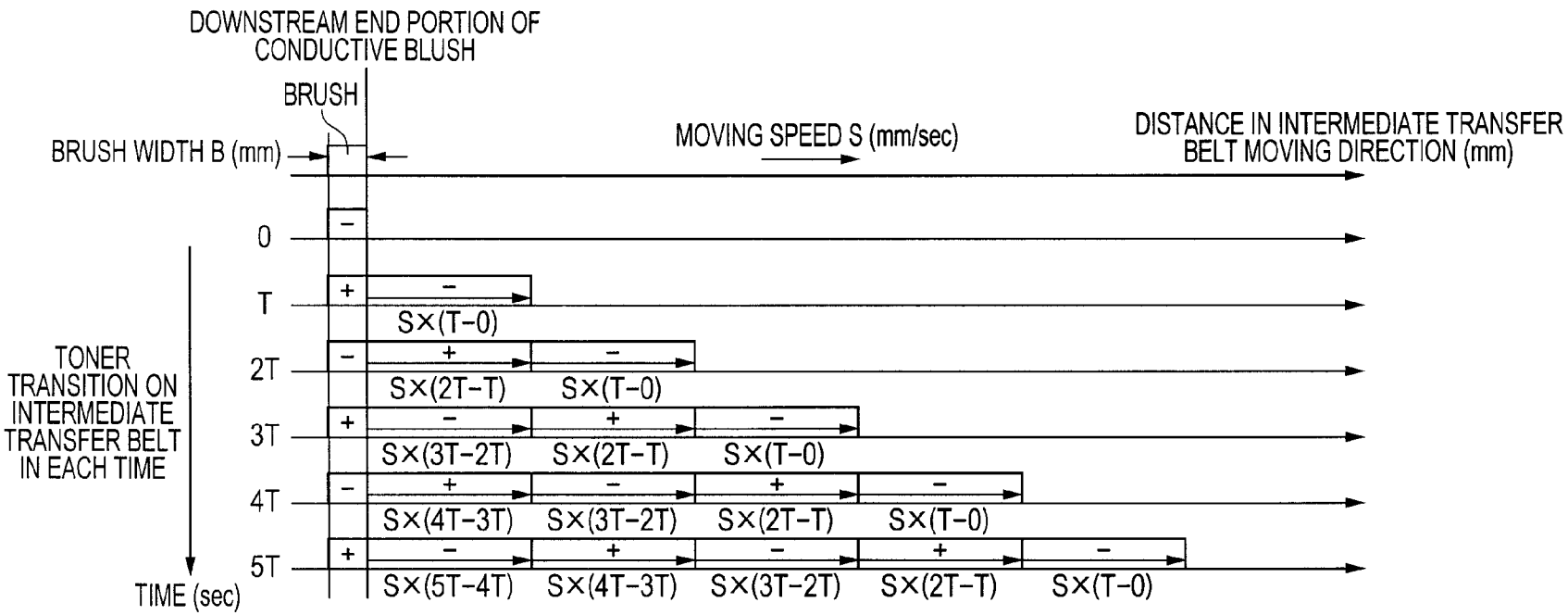
FIG. 9 is an explanatory view illustrating an example of a transfer of a position of discharged toner on an intermediate transfer belt in each time during the discharge step.

FIG. 9 illustrates a variation with the elapsed time of a position of discharged toner on the intermediate transfer belt 20 in each time during the discharge step. At a timing of the time 0 second, the negatively discharged toner is transferred onto the intermediate transfer belt 20 at the position of the conductive brush 31. During a period between the time 0 second and the time T seconds, the negative discharged toner discharged at a timing of the time 0 second moves a distance of S [mm/second]×(T−0) [second] (=S×T [mm]) while being held on the intermediate transfer belt 20. At a timing of the time T seconds, positive discharged toner is newly transferred onto the intermediate transfer belt 20 at the position of the conductive brush 31. Here, as described above, the toner held by the conductive brush 31 also includes positively charged toner. Therefore, the toner that is positively charged is also discharged even though it is in an amount smaller than the amount of the discharged toner that is negatively charged. During a period between the time T seconds and the time 2T seconds, the positive discharged toner discharged at a timing of the time T seconds moves a distance of S [mm/second]×(2T−T) [second] (=S×T [mm]) while being held on the intermediate transfer belt 20. At a timing of the time 2T seconds, negative discharged toner is newly transferred onto the intermediate transfer belt 20 at the position of the conductive brush 31.

Subsequently, at timings of the time 3T seconds, 4T seconds, and 5T seconds, and also during periods between the time 2T seconds and the time 3T seconds, between the time 3T seconds and the time 4T seconds, and between the time 4T seconds and the time 5T seconds, the operations similar to those described above are repeated. This enables the movement of discharged toner and the transfer of discharged toner from the conductive brush 31 to the intermediate transfer belt 20 to be performed. Note that, as described above, at timings of the time 0 second, T seconds, 2T seconds, 3T seconds, 4T seconds, and 5T seconds that are switch timings of the polarity of a discharge voltage, a large amount of toner is discharged from the conductive brush 31 onto the intermediate transfer belt 20. However, a slight amount of toner is also discharged even during the application of a discharge voltage between the time 0 second and the time T seconds, between the time T seconds and the time 2T seconds, between the time 2T seconds and the time 3T seconds, between the time 3T seconds and the time 4T seconds, and between the time 4T seconds and the time 5T seconds after the switch timings.

Next, the positional relationship of the primary transfer part in which the discharged toner can be collected satisfactorily is described. Note that, in this embodiment, the position of the first voltage application part N3 is represented by the position at a downstream side end portion in the moving direction of the intermediate transfer belt 20 in a region where the conductive brush 31 and the intermediate transfer belt 20 are in contact. In this embodiment, the position of the primary transfer part N1 is represented by the position at the center in the moving direction of the intermediate transfer belt 20 in a region where the photosensitive drum 2 and the intermediate transfer belt 20 are in contact in the primary transfer part N1.

Figure 10:
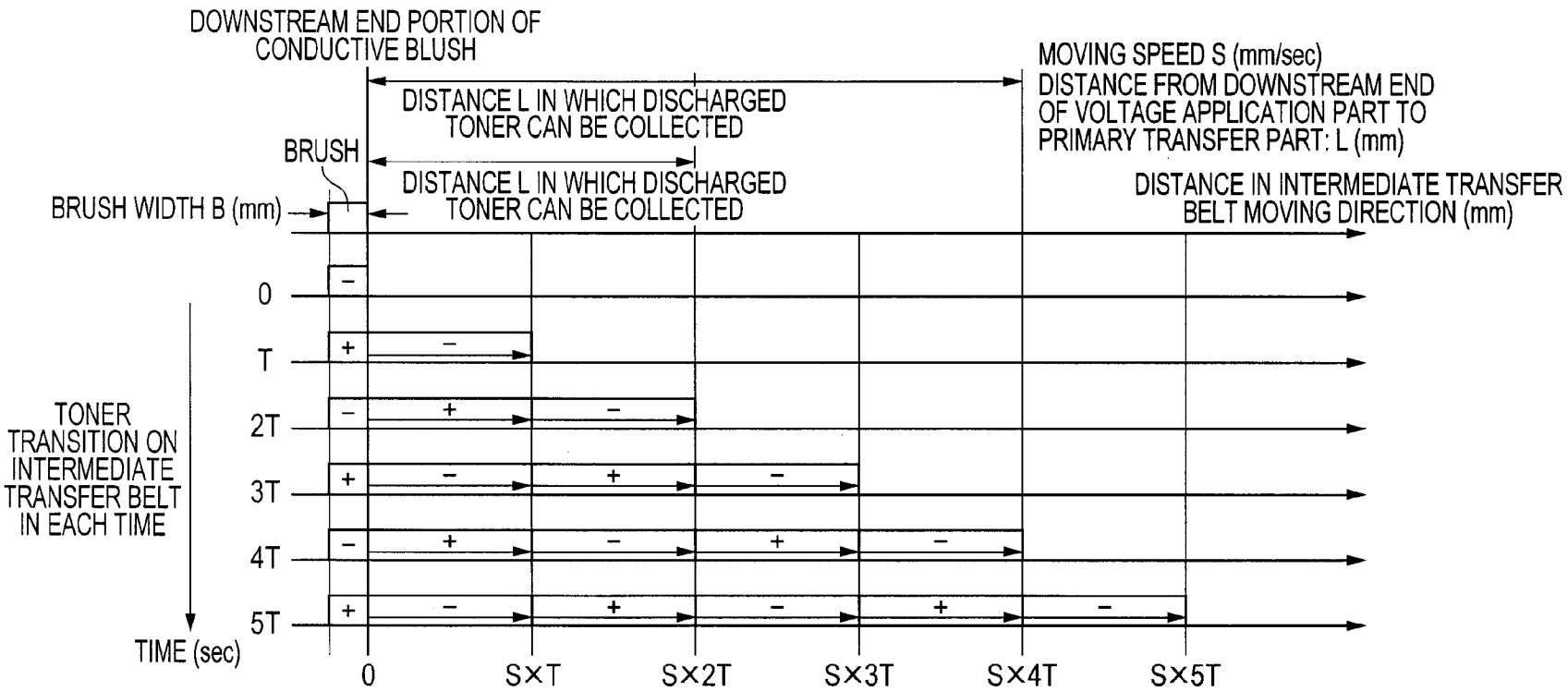
FIG. 10 is an explanatory view illustrating a positional relationship of a primary transfer part.

FIG. 10 illustrates a positional relationship of the primary transfer part N1*a* in which discharged toner can be collected onto the photosensitive drum 2*a* of the first image forming part 1*a*, in a diagram similar to FIG. 9.

In FIG. 10, the case where the primary transfer part N1*a* of the first image forming part 1*a* is present at the leading end position of the negative discharged toner on the intermediate transfer belt 20 at the timing of the time 2T seconds is considered. That is, the case where the primary transfer part N1*a* of the first image forming part 1*a* is present at the position of S×2T [mm] in the moving direction of the intermediate transfer belt 20, with the position of the first voltage application part N3 (position of the downstream side end portion) being a reference position (0 mm), is considered. During the period between the time 2T seconds and the time 3T seconds, a negative voltage is applied to the primary transfer roller 5*a* of the primary transfer part N1*a* by the power source 40 common to that of the conductive brush 31. Further, the length of the negative discharged toner (discharged at the timing of time 0 second and during the period between the time 0 second and the time T seconds) on the intermediate transfer belt 20 is S×T [mm]. Thus, during the application time period of the negative voltage to the primary transfer roller 5*a* just between the time 2T seconds and the time 3T seconds, the negative discharged toner can be collected onto the photosensitive drum 2*a* of the first image forming part 1*a*. During the period between the time 3T seconds and the time 4T seconds, the positive voltage is applied to the primary transfer roller 5*a* of the primary transfer part N1*a* by the power source 40 common to that of the conductive brush 31. Further, the length of the positive discharged toner (discharged at the timing of time T seconds and during the period between the time T seconds and the time 2T seconds) on the intermediate transfer belt 20 is S×T [mm]. Thus, during the application time period of a positive voltage to the primary transfer roller 5*a* just between the time 3T seconds and the time 4T seconds, the positive discharged toner can be collected onto the photosensitive drum 2*a* of the first image forming part 1*a*.

After that, the negative discharged toner whose leading end has reached the primary transfer part N1*a* at a timing of the time 4T seconds and the positive discharged toner whose leading end has reached the primary transfer part N1*a* at a timing of the time 5T seconds can be collected onto the photosensitive drum 2*a* similarly.

It is understood from the above that, in order to collect the discharged toner onto the photosensitive drum 2*a* of the first image forming part 1*a*, the position of the primary transfer part N1*a* of the first image forming part 1*a* preferably satisfies the following relationships even in this embodiment in the same way as the first embodiment.

(1) The negative voltage is applied to the primary transfer roller 5*a* when the leading end of the negative discharged toner reaches the primary transfer part N1*a*, and on the contrary the positive voltage is applied to the primary transfer roller 5*a* when the leading end of the positive discharged toner reaches the primary transfer part N1*a*.

(2) The trailing end of negative discharged toner has passed completely through the primary transfer part N1*a* before the negative voltage applied to the primary transfer roller 5*a* starts being switched to the positive voltage. On the contrary, the trailing end of positive discharged toner has passed completely through the primary transfer part N1*a* before the positive voltage applied to the primary transfer roller 5*a* starts being switched to the negative voltage.

Therefore, similarly to the first embodiment, in order to enable the satisfactory collection of discharged toner onto the photosensitive drum 2*a* in the primary transfer part N1*a* of the first image forming part 1*a*, the following relationship:

$$L \approx S \times (2 \times n \times T) \text{(where n is a natural number)} \quad (5)$$

is preferably satisfied. That is, the following relationship:

$$T \approx L/(S \times 2 \times n) \text{(where n is a natural number)} \quad (6)$$

is preferably satisfied.

Note that, in order to satisfactorily collect both the negative and positive discharged toners, which are discharged onto the intermediate transfer belt 20 in the first voltage application part N3, onto the photosensitive drum 2*a* in the primary transfer part N1*a* of the first image forming part 1*a*, it is necessary that the relationship of $2T<L/S$ is satisfied.

As described above, as a more detailed discharged toner state, the conductive brush 31 discharges a large amount of toner at a switch timing of the polarity of a discharge voltage, and discharges a slight amount of toner even during the application of a discharge voltage after the switch of the polarity of a discharge voltage.

In this embodiment, a relationship between the length S×T [mm] of discharged toner on the intermediate transfer belt 20 discharged during the unit discharge time period T [second] and the width B [mm] of the conductive brush 31 is $S \times T > B$ (that is, $T > B/S$). Then, a large amount of toner is discharged onto the intermediate transfer belt at a switch timing of the polarity of a discharge voltage, and the amount of discharged toner with the steady-state current after the switch of the polarity of a discharge voltage is small. Therefore, in the case where there are no problems in terms of practical use, no collection of the discharged toner with the steady-state current after the polarity of a discharge voltage is switched can be permitted as desired. This can further enlarge the range of the position of the primary transfer part N1*a* where the discharged toner can be collected onto the photosensitive drum 2*a* of the first image forming part 1*a*.

Figure 11:
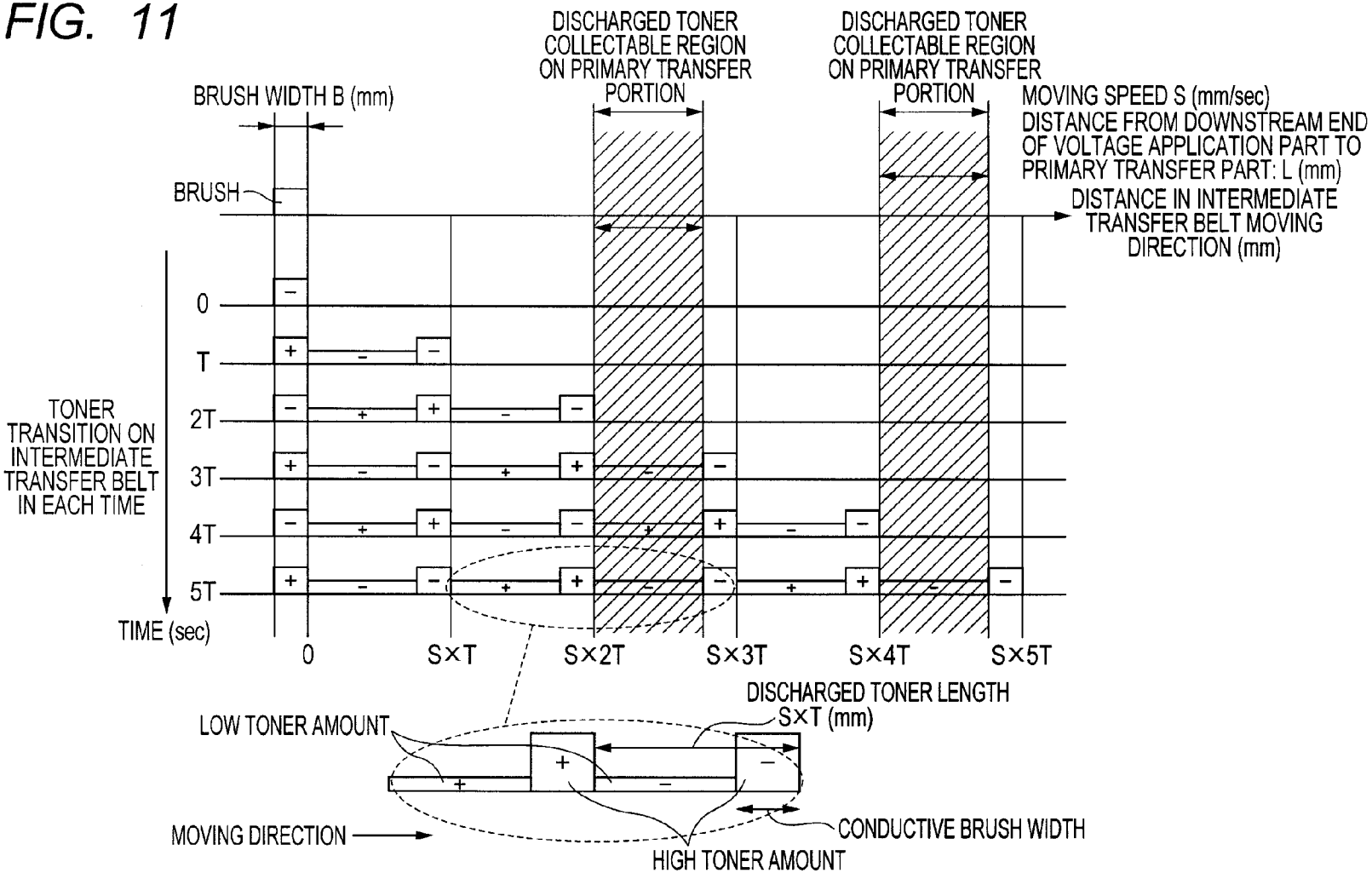
FIG. 11 is a more detailed explanatory view illustrating the positional relationship of the primary transfer part.

FIG. 11 illustrates a more detailed state of discharged toner on the intermediate transfer belt 20 in each time during the discharge step, in a diagram similar to FIG. 10.

In FIG. 11, the case where the primary transfer part N1*a* of the first image forming part 1*a* is present at the leading end position of negative discharged toner on the intermediate transfer belt 20 at a timing of the time 2T seconds is considered. That is, the case where the primary transfer part N1*a* collecting discharged toner is present at the position of S×2T [mm] in the moving direction of the intermediate transfer belt 20, with the position (position of the downstream side end portion) of the first voltage application part N3 being a reference position (0 mm), is considered.

During a period between the time 2T seconds and the time 3T seconds, a negative voltage is applied to the primary transfer roller 5*a* of the primary transfer part N1*a* by the power source 40 common to that of the conductive brush 31. Therefore, the negative discharged toner in the primary transfer part N1*a* of the first image forming part 1*a* can be collected. After that, the negative discharged toner whose leading end has reached the primary transfer part N1*a* at a timing of the time 4T seconds and the positive discharged toner whose leading end has reached the primary transfer part N1*a* at a timing of the time 5T seconds can also be collected by the primary transfer part N1*a* of the first image forming part 1*a*. Next, in FIG. 11, the case where the primary transfer part N1*a* is present at the trailing end position of the region discharged substantially with a width (width with regard to the moving direction of the intermediate transfer belt 20) of the conductive brush 31 of the region of the leading negative discharged toner at a timing of the time 3T seconds is considered. That is, the case where the primary transfer part N1*a* of the first image forming part 1*a* is present at the position of S×3T−B [mm] in the moving direction of the intermediate transfer belt 20, with the position (position of a downstream side end portion) of the first voltage application part N3 being a reference position (0 mm), is considered. During a period between the time 2T seconds and the time 3T seconds, a negative voltage is applied to the primary transfer roller 5*a* of the primary transfer part N1*a* by the power source 40 common to that of the conductive brush 31. Therefore, the discharged toner in the trailing end portion of the negative discharged toner corresponding to the width of the conductive brush 31 has been collected completely at a timing of the time 3T seconds. Thus, in the primary transfer part N1*a* of the first image forming part 1*a*, toner in a portion including a larger amount of toner of the discharged toner on the intermediate transfer belt 20 can be collected.

After that, positive discharged toner in which a trailing end portion of the portion including the larger amount of toner has passed completely through the primary transfer part N1*a* of the first image forming part 1*a* at a timing of the time 4T seconds can also be collected in the primary transfer part N1*a* of the first image forming part 1*a* similarly. Further, negative discharged toner in which the trailing end portion of the portion including the larger amount of toner has passed completely through the primary transfer part N1*a* of the first image forming part 1*a* at a timing of the time 5T seconds can also be collected in the primary transfer part N1*a* of the first image forming part 1*a* similarly.

More specifically, in the case where the following relationship:

$$S \times 2T \leqq L \leqq S \times 3T - B$$

is satisfied, at least the portion of discharged toner including the larger amount of toner corresponding to the width of the conductive brush 31 can be collected onto the photosensitive drum 2*a* in the primary transfer part N1*a* of the first image forming part 1*a*. That is, at least when the negative discharged toner of the portion corresponding to the width of the conductive brush 31 passes through the primary transfer part N1*a*, a negative voltage is applied to the primary transfer part N1*a*. Further, at least when the positive discharged toner of the portion corresponding to the width of the conductive brush 31 passes through the primary transfer part N1*a*, a positive voltage is applied to the primary transfer part N1*a*. Therefore, those toners can be collected to the photosensitive drum 2*a* in the primary transfer part N1*a* of the first image forming part 1*a*.

Next, in FIG. 11, the case where the primary transfer part N1*a* is present at the trailing end position of the region discharged substantially with the width (width in the moving direction of the intermediate transfer belt 20) of the conductive brush 31 of the region of the leading negative discharged toner at a timing of the time 5T seconds is considered. That is, the case where the primary transfer part N1*a* of the first image forming part 1*a* is present at the position of S×5T−B [mm] in the moving direction of the intermediate transfer belt 20, with the position (position of the downstream side end portion) of the first voltage application part N3 being a reference position (0 mm), is considered.

As is understood from FIG. 11, in this case, even when the following relationship:

$$S\times 4T\leqq L\leqq S\times 5T-B$$

is satisfied, at least the portion of discharged toner including the larger amount of toner corresponding to the width of the conductive brush 31 can be collected onto the photosensitive drum 2*a* in the primary transfer part N1*a* of the first image forming portion 1*a*.

It is understood from the above that, in the case where the following relationship is satisfied, at least the portion of discharged toner including the larger amount of toner corresponding to the width of the conductive brush 31 can be collected onto the photosensitive drum 2*a* in the primary transfer part N1*a* of the first image forming part 1*a*.

$$S\times 2\times n\times T\leqq L\leqq S\times(2\times n+1)T-B \quad (7)$$

(where n is a natural number)

That is, under a certain distance L [mm], in the case where the unit discharge time period T [second] satisfies the following relationship:

$$L/(S\times 2\times n)\geqq T\geqq(L+B)/(S\times(2n+1)) \quad (8)$$

(where n is a natural number), discharged toner can be collected onto the photosensitive drum 2*a* in the primary transfer part N1*a* of the first image forming part 1*a* sufficiently to an acceptable degree.

In this embodiment, the discharged toner from the conductive brush 31 is collected by the drum cleaning device 6*a* of the first image forming part 1*a*, and the moving distance L of the intermediate transfer belt 20 from the first voltage application part N3 (downstream side end portion) to the primary transfer part N1*a* is 100 mm. As described above, the moving speed S of the intermediate transfer belt 20 is 100 mm/second, and the width B (width of the contact portion (first voltage application part N3) between the intermediate transfer belt 20 and the conductive brush 31) of the conductive brush 31 in the moving direction of the intermediate transfer belt 20 is 5 mm. Therefore, from the above-mentioned expression (8), the following relationship:

$$0.5/n\geqq T\geqq 1.05/(2n+1)$$

(where n is a natural number)

is required to be satisfied.

Here, in order to maximize the effect of the present invention, it is more preferred to set a condition under which discharged toner after the switch of the polarity of a discharge voltage can also be collected.

Specifically, from the above-mentioned expression (6), it is preferred to select a time closer to L/(S×2×n) as the unit discharge time period T.

The control mode of the image forming apparatus 100 of this embodiment is the same as that of the first embodiment. However, in this embodiment, the CPU 51 of the control part 50 controls an output of the power source 40 that applies a voltage to the conductive brush 31 and the primary transfer rollers 5*a* to 5*d*. Further, in this embodiment, the CPU 51 of the control part 50 also controls an output of the toner charge power source 42 that applies a voltage to the toner charging roller 32. Further, in the case of adopting a configuration in which the toner charging roller 32 is separated from the intermediate transfer belt 20 during the discharge step, the CPU 51 of the control part 50 also controls the operation of this separation mechanism.

As described above, in this embodiment, during the discharge step, the power source 40 switches the polarity of the voltage to be applied from the second polarity to the first polarity before the region of the intermediate transfer belt 20 that is in contact with the conductive brush 31 reaches the primary transfer part N1*a* in the first time band. Further, during the discharge step, the power source 40 switches the polarity of the voltage to be applied from the first polarity to the second polarity before the region of the intermediate transfer belt 20 that is in contact with the conductive brush 31 reaches the primary transfer part N1*a* in the second time band.

Preferably, during the discharge step, the power source 40 continues to apply a voltage of the first polarity until the region of the intermediate transfer belt 20 that is in contact with the conductive brush 31 passes through the primary transfer part N1*a* in the first time band. Further, preferably, during the discharge step, the power source 40 continues to apply a voltage of the second polarity until the region of the intermediate transfer belt 20 that is in contact with the conductive brush 31 passes through the primary transfer part N1*a* in the second time band.

Thus, the discharged toner from the conductive brush 31 can be collected satisfactorily onto the photosensitive drum 2*a* in the primary transfer part N1*a* of the predetermined image forming part 1*a*, and the cleaning defective image and the contamination of a back side of the recording material P caused by discharged toner can be suppressed.

Third Embodiment

Next, another embodiment according to the present invention is described. The basic configuration and operation of the image forming apparatus of this embodiment are the same as those of the second embodiment, and this embodiment is different from the second embodiment in that an image forming part that is a collection destination of discharged toner can be selected. Thus, the elements having functions and configurations that are the same as or correspond to those of the second embodiment are denoted with the same reference symbols as those therein, and the detailed description thereof is omitted.

In this embodiment, discharged toner from the conductive brush 31 can be collected in any of the image forming parts 1*a* to 1*d*. This can suppress discharged toner from being collected in a large amount in a toner container of a drum cleaning device of a particular image forming part in this embodiment.

In this embodiment, the amount of toner in the toner container of the drum cleaning device 6 of the each image forming part 1 is monitored, and discharged toner is selectively collected in the image forming part 1 in which the amount of toner is smaller. This can suppress a replacement frequency of the toner container (or a cartridge integrated with a toner container) of the drum cleaning device 6 of the particular image forming part 1 from increasing. Hereinafter, a more detailed description is made.

Next, a method of collecting discharged toner from the conductive brush 31 selectively in any image forming part 1 is described.

In this embodiment, the primary transfer roller 5 of the image forming part 1 by which discharged toner is not desired to be collected is separated from the intermediate transfer belt 20. That is, the primary transfer roller 5 of the image forming part 1 positioned on an upstream side of the image forming part 1 that collects discharged toner in the moving direction of the intermediate transfer belt 20 is separated from the intermediate transfer belt 20. Thus, the intermediate transfer belt 20 pressed against the photosensitive drum 2 of the image forming part 1 is separated from the photosensitive drum 2 by the separated primary transfer roller 5.

Specifically, for example, bearing members at both ends in the rotation axis direction of the primary transfer roller 5 can be moved by appropriate moving means such as a cam, a solenoid, etc. This can move each of the primary transfer rollers 5 alternatively between the position abutting on the intermediate transfer belt 20 and the position separated therefrom. In this embodiment, the primary transfer parts 5*a* to 5*d* of the first to third image forming parts 1*a* to 1*c* can be separated from the intermediate transfer belt 20.

Figure 12:
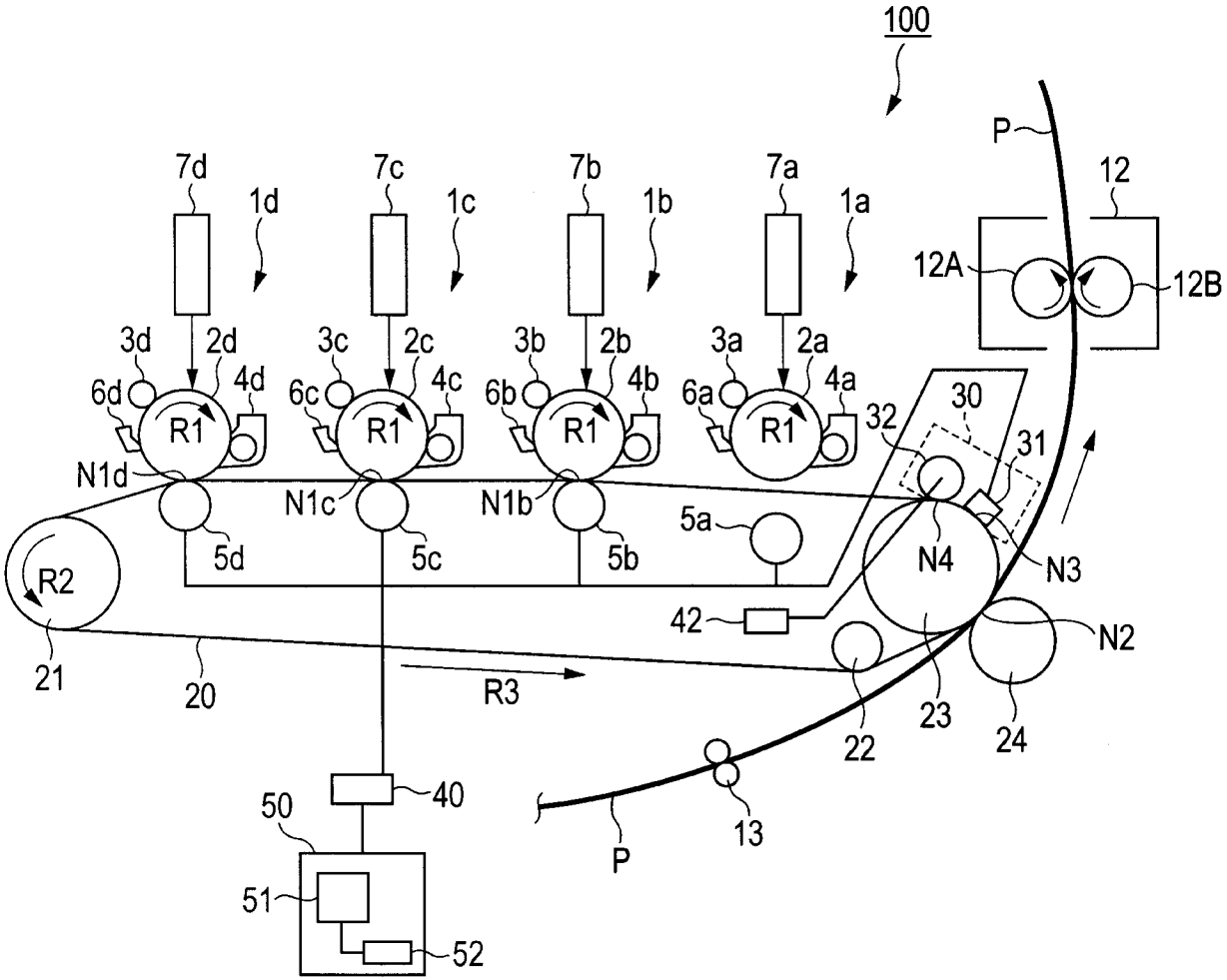
FIG. 12 is a schematic cross-sectional view of an image forming apparatus according to still another embodiment of the present invention.

FIG. 12 illustrates a state in which the primary transfer roller 5*a* of the first image forming part 1*a* is separated from the intermediate transfer belt 20. In the first image forming part 1, along with the separation of the primary transfer roller 5*a* from the intermediate transfer belt 20, the intermediate transfer belt 20 is also separated from the photosensitive drum 2*a*, and toner cannot be transferred from the intermediate transfer belt 20 onto the photosensitive drum 2*a* anymore. This can prevent discharged toner from being collected by the first image forming part 1*a*.

When only the primary transfer roller 5*a* of the first image forming part 1*a* is separated from the intermediate transfer belt 20, the discharged toner is transported while being borne on the intermediate transfer belt 20 without being collected by the first image forming part 1*a*. Then, in the moving direction of the intermediate transfer belt 20, the discharged toner is collected by the second image forming part 1*b* on a downstream side of the first image forming part 1*a*. Similarly, when the primary transfer rollers 5*a*, 5*b* of the first and second image forming parts 1*a*, 1*b* are separated from the intermediate transfer belt 20, the discharged toner is collected by the third image forming part 1*c* on a downstream side of the second image forming part 1*b*. Further, when the primary transfer rollers 5*a*, 5*b*, and 5*c* of the first, second, and third image forming parts 1*a*, 1*b*, and 1*c* are separated from the intermediate transfer belt 20, the discharged toner is collected by the fourth image forming part 1*d* on a downstream side of the third image forming part 1*c*. Unless the primary transfer roller 5*a* of the first image forming part 1*a* is separated from the intermediate transfer belt 20, the discharged toner is collected by the first image forming part 1*a*.

Thus, the discharged toner can be selectively collected in the toner container of the belt cleaning device 6 of any image forming part 1. At this time, in order to collect the discharged toner sufficiently to an acceptable degree, it is necessary to satisfy Expression (7) or (8) regarding any image forming part 1 by which the discharged toner is desired to be collected in the same way as in the second embodiment. In order to collect the discharged toner satisfactorily, it is preferred to satisfy Expression (5) or (6) regarding any image forming part 1 by which the discharged toner is desired to be collected in the same way as in the second embodiment. In this embodiment, L [mm] in Expressions (5), (6), (7), and (8) refers to a moving distance of the intermediate transfer belt 20 from the first voltage application part N3 (downstream side end portion) to the primary transfer part N1 of the image forming part 1 by which the discharged toner is collected.

In this embodiment, similarly to the second embodiment, the width B of the conductive brush 31 in the moving direction of the intermediate transfer belt 20 is 5 mm, and the moving speed S of the intermediate transfer belt 20 is 100 mm/second. Then, in this embodiment, the unit discharge time period T is 0.45 seconds. Thus, each of the following relationships holds from Expression (7).

$$90\times n \leqq L \leqq 45\times(2n+1)-5 \text{ (}n\text{ is a natural number)}$$

$$90 \leqq L \leqq 130 \text{ (when n=1)}$$

$$180 \leqq L \leqq 220 \text{ (when n=2)}$$

$$270 \leqq L \leqq 310 \text{ (when n=3)}$$

$$360 \leqq L \leqq 400 \text{ (when n=4)}$$

In this embodiment, L is 100 mm regarding the first image forming part 1*a*. Further, L is 190 mm regarding the second image forming part 1*b*. Further, L is 280 mm regarding the third image forming part 1*c*. Further, L is 370 mm regarding the fourth image forming part 1*d*. Thus, even regarding any of the image forming parts 1*a* to 1*d*, the distance L [mm] satisfies Expression (7). Therefore, even in any of the image forming parts 1*a* to 1*d*, the discharged toner can be collected.

The control form of the image forming apparatus 100 of this embodiment is the same as that of the second embodiment, and hence, the description thereof is omitted.

Figure 13:
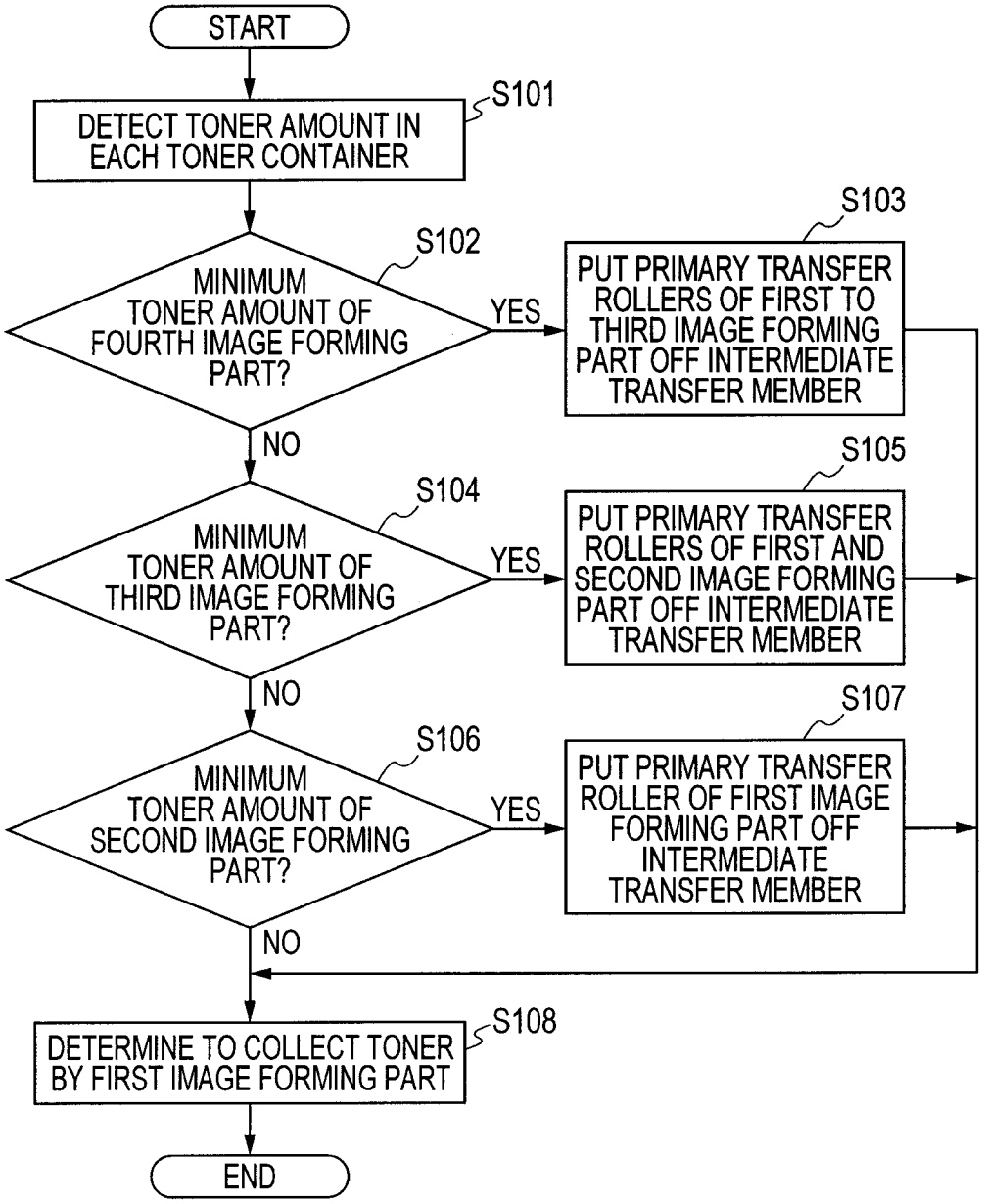
FIG. 13 is a flowchart illustrating an example of control in the case of putting a primary transfer roller off an intermediate transfer member during a discharge step.

FIG. 13 illustrates an example of a flow of control of the operation of separating the primary transfer roller 5 in the discharge step. When the CPU 51 starts the discharge step, the CPU 51 detects the amounts of toner in the toner containers of the drum cleaning devices 6*a* to 6*d* of the first to fourth image forming parts 1*a* to 1*d* (S101). The amount of toner in the toner container can be detected using any toner amount detecting means capable of detecting the amount of toner in the toner container. For example, optical type, capacitance detecting type, and piezoelectric type toner amount detecting means is well-known in this field. The CPU 51 compares the read toner amounts in the respective toner containers, and determines whether or not the toner amount in the toner container of the fourth image forming part 1*d* is the smallest (S102). In the case where the CPU 51 determines that the toner amount in the fourth image forming part 1*d* is the smallest, the CPU 51 determines that the discharged toner be collected by the fourth image forming part 1*d* and puts the primary transfer rollers 5*a* to 5*c* of the first to third image forming parts 1*a* to 1*c* off the intermediate transfer member (S103). Similarly, in the case where the CPU 51 determines that the toner amount in the third image forming part 1*c* is the smallest (S104), the CPU 51 determines that the discharged toner be collected by the third image forming part 1*c* and puts the primary transfer rollers 5*a*, 5*b* of the first and second image forming parts 1*a*, 1*b* off the intermediate transfer member (S105). Similarly, in the case where the CPU 51 determines that the toner amount in the second image forming part 1*b* is the smallest (S106), the CPU 51 determines that the discharged toner be collected by the second image forming part 1*b*, and puts the primary transfer roller 5*a* of the first image forming part 1*a* off the intermediate transfer member (S105). Then, in the case where the CPU 51 determines that none of the toner amounts in the toner containers of the second to fourth image forming parts 1*b* to 1*d* is the smallest, the CPU 51 determines that the discharged toner be collected by the first image forming part 1*a* (S108). In this case, the separation operation of the primary transfer rollers 5*a* to 5*c* are not performed in any of the first to third image forming parts 1*a* to 1*c*.

As described above, in this embodiment, the same effects as those in the first and second embodiments can be exhibited, and the discharged toner can be collected by any image forming part 1, which can prevent only the toner container of the particular image forming part 1 from containing a large collected amount of toner.

Fourth Embodiment

Next, another embodiment of the present invention is described. In the first to third embodiments, the present invention is applied to a tandem-type image forming apparatus. However, the present invention is not limited thereto. The present invention can also be applied to a so-called four-cycle type image forming apparatus and the same effects can be obtained.

Figure 14:
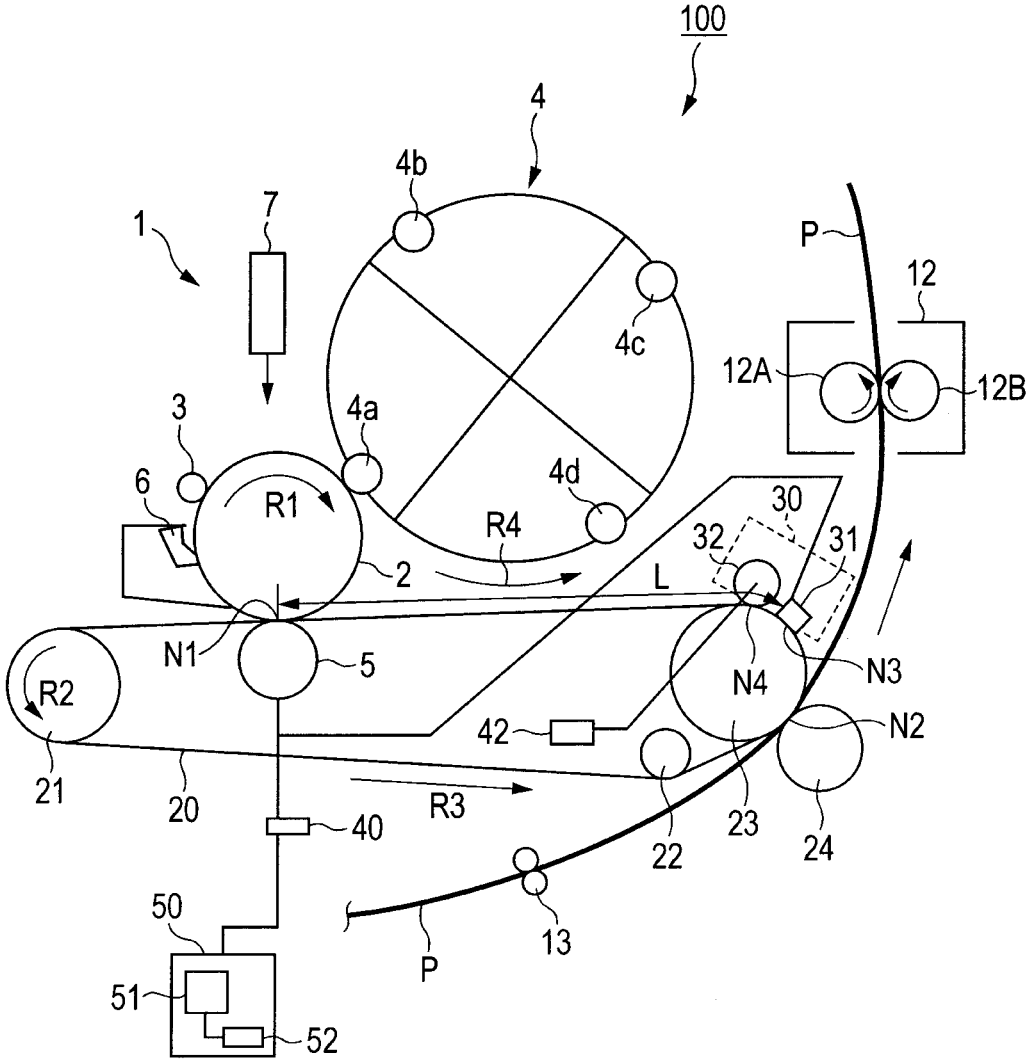
FIG. 14 is a schematic cross-sectional view of an image forming apparatus according to still another embodiment of the present invention.

FIG. 14 illustrates a schematic cross-section of an image forming apparatus of this embodiment. The image forming apparatus of this embodiment is a four-cycle type full-color printer adopting an intermediate transfer system capable of forming a full-color image using an electrophotographic system.

Note that, the elements having functions and configurations that are the same as or correspond to those of the image forming apparatus in each of the first to third embodiments are denoted with the same reference symbols as those therein, and the detailed description thereof are omitted.

The image forming apparatus 100 of this embodiment includes a single image forming part 1. The image forming part 1 is provided with a photosensitive drum 2, a charging roller 3, a rotation developing device 4, a primary transfer roller 5, and a drum cleaning device 6. The rotation developing device 4 includes first, second, third, and fourth developing devices 4*a*, 4*b*, 4*c*, and 4*d* attached to a rotatable support (rotator). Each of the developing devices 4*a*, 4*b*, 4*c*, and 4*d* contains yellow, magenta, cyan, and black toner as a developer. Then, when the support rotates in a direction indicated by the arrow R4 in FIG. 14, any of the developing devices 4*a* to 4*d* to be used for development can be placed at developing positions opposed to the photosensitive drum 2.

For example, at a time of forming a full-color image, first, an electrostatic latent image according to yellow image information is formed on the photosensitive drum 2, and the electrostatic latent image is developed using the first developing device 1*a*. A yellow toner image formed on the photosensitive drum 2 is transferred onto the intermediate transfer belt 20 in the primary transfer part N1. After that, similarly, every time electrostatic latent images according to magenta, cyan, and black image information are formed on the photosensitive drum 2, the respective electrostatic latent images are developed using the second, third, and fourth developing devices 4*b*, 4*c*, and 4*d*. Further, every time magenta, cyan, and black toner images are formed on the photosensitive drum 2, the respective toner images are transferred while being superimposed on the toner images that have already been transferred onto the intermediate transfer belt 20 in the primary transfer part N1. Every time a toner image is primarily transferred, the intermediate transfer belt 20 turns around for primarily transfer of a toner image of a subsequent color. Then, when toner images of four colors are primarily transferred onto the intermediate transfer belt 20, the toner images are secondarily transferred at a time onto the recording material P in the secondary transfer part N2.

The residual toner remaining on the intermediate transfer belt 20 after the secondary transfer is cleaned by the belt cleaning device 30. The configuration and operation of the belt cleaning device 30 are substantially the same as those of the second embodiment. However, in this embodiment, when a toner image primarily transferred onto the intermediate transfer belt 20 passes the first and second voltage application parts N3, N4, the conductive brush 31 and the toner charging roller 32 are separated from the intermediate transfer belt 20. The conductive brush 31 and the toner charging roller 32 can be separated from the intermediate transfer belt 20 by a separation mechanism similar to that in the case of separating the toner charging roller 32 in the second embodiment. In this embodiment, the conductive brush 31 in the cleaning device 30 is connected to the power source 40 common to the primary transfer roller 5 so that a predetermined DC voltage is applied to the conductive brush 31, in the same way as in the second embodiment.

Even in the image forming apparatus 100 of this embodiment, it is necessary to satisfy Expression (7) or (8) in the same way as in the second embodiment, so as to collect discharged toner sufficiently to an acceptable degree. Note that, in order to collect discharged toner more satisfactorily, it is preferred to satisfy Expression (5) or (6) in the same way as in the second embodiment. In this embodiment, L [mm] in Expressions (5), (6), (7), and (8) refers to a moving distance of the intermediate transfer belt 20 from the first voltage application part N3 (downstream side end portion) to the primary transfer part N1 of the signal image forming part 1.

In this embodiment, the moving distance L of the intermediate transfer belt 20 from the first voltage application part N3 (downstream side end portion) to the primary transfer part N1 is 100 mm. Further, in this embodiment, similarly to the second embodiment, the moving speed S of the intermediate transfer belt 20 is 100 mm/second, and the width B of the conductive brush 31 in the moving direction of the intermediate transfer belt 20 is 5 mm. In this embodiment, the unit discharge time period T is 0.5 seconds. Thus, the image forming apparatus 100 of this embodiment satisfies Expression (8) and further Expression (6). Therefore, the discharged toner can be collected satisfactorily to the photosensitive drum 2 in the primary transfer part N1.

In this embodiment, the case where the belt cleaning device 30 includes the conductive brush 31 and the toner charging roller 32 in the same way as in the second embodiment has been illustrated. However, the present invention is not limited thereto, and the belt cleaning device 30 may include only the toner charging roller 32 in the same way as in the first embodiment. In this case, in order to collect discharged toner sufficiently to an acceptable degree, it is necessary to satisfy Expression (1) or (2) in the same way as in the first embodiment. Further, in this case, in order to collect discharged toner more satisfactorily, it is preferred to satisfy Expression (3) or (4) in the same way as in the first embodiment.

As described above, the present invention can also be applied to a four-cycle type image forming apparatus and can exhibit the same effects as those in the case of the tandem-type image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-019801, filed Jan. 29, 2010, which is hereby incorporated by reference herein in its entirety.

What is claimed is:

1. An image forming apparatus, comprising:

an image bearing member that bears a toner image;

an intermediate transfer member which is rotatable;

a primary transfer member that transfers the toner image from the image bearing member onto the intermediate transfer member in a primary transfer part;

a secondary transfer member that transfers the toner image from the intermediate transfer member onto a transfer material in a secondary transfer part;

a toner charging member that is provided downstream of the secondary transfer part and upstream of the primary transfer part in a moving direction of the intermediate transfer member, and charges residual toner remaining on the intermediate transfer member; and a common power source that applies a voltage to the primary transfer member and/or the toner charging member, wherein the image forming apparatus is capable of performing a belt cleaning mode in which the residual toner is charged in an opposite polarity opposite to a normal polarity of toner by the toner charging member, and then the charged residual toner is transferred from the intermediate transfer member to the image bearing member by the primary transfer member, and a toner charging member cleaning mode in which the residual toner adhering to the toner charging member is transferred from the toner charging member to the intermediate transfer member, and after then residual toner transferred from the toner charging member to the intermediate transfer member is transferred from the intermediate transfer member to the image bearing member by the primary transfer member, wherein the common power source applies one of voltages of a first polarity and a second polarity opposite to the first polarity, into the primary transfer member and the toner charging member simultaneously; and wherein in a case of performing the toner charging member cleaning mode, the common power source applies the voltage of the first polarity to the primary transfer member and the toner charging member at a timing at which the residual toner, which is transferred from the toner charging member to the intermediate transfer member when the voltage of the first polarity is applied to the toner charging member, reaches the primary transfer part.

2. An image forming apparatus according to claim 1, wherein in the voltage application by the common power source in the toner charging member cleaning mode, the voltages of the first polarity and the second polarity are alternatively applied to the primary transfer member and the toner charging member; and wherein before the residual toner transferred from the toner charging member to the intermediate transfer member by applying the voltage of the first polarity to the toner charging member reaches the primary transfer part, the common power source switches a voltage to be applied to the primary transfer member and the toner charging member from the voltage of the second polarity to the voltage of the first polarity.

3. An image forming apparatus according to claim 1, wherein in the case of performing the toner charging member cleaning mode, the common power source continues to apply the voltage of the first polarity to the primary transfer member and the toner charging member, until the residual toner transferred from the toner charging member to the intermediate transfer member by applying the voltage of the first polarity to the toner charging member reaches the primary transfer part.

4. An image forming apparatus according to claim 1, wherein the toner charging member includes a roller that rotates while being in contact with the intermediate transfer member; and assuming that a radius of the roller is defined as R (mm), a moving distance of the intermediate transfer member from a contact portion between the toner charging member and the intermediate transfer member to the primary transfer part is defined as L (mm), a length of a time during which the common power source applies the voltage of the first polarity to the primary transfer member and the toner charging member is defined as T (second), and a moving speed of the intermediate transfer member is defined as S (mm/second), the following relationships are satisfied:

$$T>2\pi R/S; \text{ and}$$

$$L/(S\times 2\times n)\geqq T\geqq (L+2\pi R)/(S\times(2n+1)),$$

where n is a natural number.

5. An image forming apparatus according to claim 4, wherein the following relationship is satisfied, $$T\approx L/(S\times 2\times n),$$

where n is a natural number.

6. An image forming apparatus according to claim 1, wherein the toner charging member is a brush that rubs against the intermediate transfer member; and assuming that a moving distance of the intermediate transfer member from a contact portion between the brush and the intermediate transfer member to the primary transfer part is defined as L (mm), a length of a time during which the common power source applies the voltage of the first polarity to the primary transfer member and the toner charging member is defined as T (second), and a moving speed of the intermediate transfer member is defined as S (mm/second), the following relationships are satisfied:

$$T>B/S; \text{ and}$$

$$L/(S\times 2\times n)\geqq T\geqq (L+B)/(S\times(2n+1)),$$

where n is a natural number.

* * * * *